US008419399B2

(12) United States Patent
Kaplan et al.

(10) Patent No.: US 8,419,399 B2
(45) Date of Patent: Apr. 16, 2013

(54) ROOTS TYPE GEAR COMPRESSOR WITH HELICAL LOBES HAVING COMMUNICATION WITH DISCHARGE PORT

(75) Inventors: Jirka Kaplan, Calgary (CA); Les Davenport, De Winton (CA)

(73) Assignees: 592301 Alberta Ltd., Calgary (CA); Acceleration Enterprises Ltd., De Winton (CA)

( * ) Notice: Subject to any disclaimer, the term of this patent is extended or adjusted under 35 U.S.C. 154(b) by 777 days.

(21) Appl. No.: 12/588,788

(22) Filed: Oct. 28, 2009

(65) Prior Publication Data

US 2010/0116254 A1 May 13, 2010

(30) Foreign Application Priority Data

Oct. 28, 2008 (CA) ..... 2642172

(51) Int. Cl.
*F03C 2/00* (2006.01)
*F03C 4/00* (2006.01)
*F04C 2/00* (2006.01)

(52) U.S. Cl.
USPC .... 418/206.4; 418/78; 418/201.1; 418/206.1; 123/559.1

(58) Field of Classification Search ..... 418/201.1, 418/206.1, 206.4, 109, 76–79; 123/559.1
See application file for complete search history.

(56) References Cited

U.S. PATENT DOCUMENTS

| | | | | |
|---|---|---|---|---|
| 1,818,767 | A * | 8/1931 | Swartwout | 418/206.4 |
| 2,578,196 | A | 12/1951 | Montelius | |
| 3,531,227 | A | 9/1970 | Weatherston | |
| 4,215,977 | A | 8/1980 | Weatherston | |
| 2,014,932 | A | 9/1985 | Hallett | |
| 4,556,373 | A | 12/1985 | Soeters, Jr. | |
| 5,131,829 | A * | 7/1992 | Hampton | 418/206.4 |
| 5,769,612 | A * | 6/1998 | Thelen et al. | 417/310 |
| 2009/0148330 | A1 * | 6/2009 | Swartzlander | 418/206.5 |
| 2009/0148331 | A1 * | 6/2009 | Kaplan et al. | 418/206.4 |
| 2009/0232689 | A1 * | 9/2009 | Prior | 418/206.4 |

* cited by examiner

*Primary Examiner* — Theresa Trieu
(74) *Attorney, Agent, or Firm* — Gowling Lafleur Henderson LLP

(57) ABSTRACT

A gear compressor or supercharger for compressing compressible fluids such as air, having a pair of intermeshing helical lobed rotors. An aperture is provided on the bottom of the compressor, at a rear end thereof, which permits air from the rear interior of the compressor to be in communication with high pressure supply air which is discharged from such compressor proximate the front of such compressor, on the bottom underside portion thereof. The above modification improves the efficiency of the compressor, particularly at high revolutions.

14 Claims, 15 Drawing Sheets

ROOTS TYPE GEAR COMPRESSOR WITH HELICAL LOBES HAVING COMMUNICATION WITH DISCHARGE PORT

FIELD OF THE INVENTION

This invention relates to Roots-type gear compressors or blowers, and in one aspect thereof relates to a modified supercharger for an internal combustion engine.

BACKGROUND OF THE INVENTION AND DESCRIPTION OF THE PRIOR ART

Roots-type gear compressors are well known in the prior art, and have existed in various configurations for many years.

Such Roots style gear compressors typically comprise a pair of intermeshing rotors placed side by each so as to permit meshing of lobes on each of said rotors, for the purpose of transferring quantities of compressible fluid from a low pressure region to a high pressure region.

In early non-helix type gear compressors having lobed rotors, it was realized that at high circumferential velocities of the gear rotors in the range of 1/10 the speed of sound, adverse momentum loses become significant. These losses occur as a result of the sudden exposure of the gear wells between the gear lobes which are filled with low pressure inlet gas to the high pressure outlet region, bringing about a violent rush of high pressure gas back against the oncoming gear lobe thereby creating adverse momentum forces which impede the rotor's rotation and thereby require greater horsepower to operate.

Accordingly, in one improvement related to non-helix gear type compressors, as shown in U.S. Pat. No. 3,531,227 to Weatherston, a plurality of feedback passages were provided (by drilling or coring) extending from the discharge plenum through the sides of the cylindrical chambers containing such gears, which permitted high pressure discharge gas to then impact on a rear face of each lobe so as to allow a reaction force thereon which acts in the direction of motion of the gears and therefore functions to augment the work imparted to the gears, thereby reducing the horsepower requirement required to drive the compressor.

U.S. Pat. No. 4,215,977 also to Weatherston discloses a similar concept for providing a three-lobe (now-helix) type Roots blower with feed-back structure within the sides of the cylindrical chambers containing such rotors, to bring the gas trapped in the rotor well up to the discharge pressure prior to delivery. Specifically machined surface was provided over an angular portion $\phi$ of each of the cylindrical chambers which allowed high pressure discharge air to enter trapped wells during a rotation of the rotors to reduce discharge pulses.

Disadvantageously, in the case of the gear compressor disclosed in U.S. Pat. No. 3,531,227 the provision of a plurality of feedback passages in the sides of the chamber was an expensive machining or casting step, requiring extensive and complicated machining or creating of expensive molds, making such feature undesirably expensive.

Likewise disadvantageously in the case of the (non-helix) Roots blower disclosed in U.S. Pat. No. 4,215,977, the machined surface provided a loss of seal for a portion of the rotation of each rotor, thereby having an offsetting efficiency loss.

Roots-type superchargers or "blowers" having helical rotors have been used, such as of the type shown in U.S. Pat. No. 2,014,932, which provide for two 3-lobed rotors with an approximate 60° helical twist for the lobe on each of such two rotors, to more uniformly dispense pressurized air thereby reducing cyclical pulsing each time a trapped volume rotates into contact with the high pressure discharge air of the discharge port.

U.S. Pat. No. 4,556,373 to Soeters, Jr. teaches an improved supercharger or blower, having a pair of 3-lobed rotors, each with an approximate 60 helical twist. As shown in FIG. 9 and FIG. 16 thereof, pairs of recesses 46 and 48 in a front end wall 20 (see FIGS. 9 and 15) and pairs of recesses 58, 60 in an end wall are provided, which are variably covered and uncovered at times by the lobes of the rotors.

U.S. Pat. No. 2,578,196 to Montelius, discussed in U.S. Pat. No. 4,556,373 to Soeters, Jr. above, teaches a screw type compressor having a pair of non-uniform but meshably engageable rotors, with one end of one of the cooperating rotors being closed by a valve plate, which in the valve plate passages from each rotor groove are made adjacent to one side of the rotor threads and cooperate with a channel in the end wall, which is connected to the outlet but covered by a valve plate. The channel drains trapped volumes when exposed by said valve plate directly to the compressor discharge outlet.

More recently, superchargers which are adapted for mounting on engine blocks of engines over the air inlet therefor, having rotors with helically arranged lobes such as those manufactured by Kobelco Compressors (America) Inc., have become publicly available. These are of the "backflow" type, where air is drawn in at a location proximate the front end thereof and proximate the top of the blower/supercharger, and which by rotating helixes on each of the rotors is drawn downwardly and axially rearwardly, whereupon on reaching the opposite end wall of the blower/supercharger, is forced backwards via said helical lobes on said rotors and forcefully expelled from a high pressure discharge port on the bottom side of the blower towards the front end of such compressor.

A need exists for modifying superchargers and gear compressors for increased efficiency so as to require less horsepower for providing the same volume and pressure of compressed air or compressible fluid.

SUMMARY OF THE INVENTION

The present invention broadly relates to modifications to a gear compressor or supercharger for compressing compressible fluids such as air, having pair of elongate helical rotors positioned in juxtaposed relation.

Such modifications as described below result in a decrease in the required horsepower to compress a given amount of air where air is the compressible fluid being compressed, and similarly for a given horsepower increase the amount air capable of being compressed.

The modifications described herein are principally of two main types, each somewhat different in operation and configuration. In a first modification (hereinafter "the First Mod") a cavity, chamber, or plenum is provided at a rear end of such gear compressor opposite an inlet and exit end, said plenum situated below an axis of rotation of said helical rotors. In a preferred embodiment thereof the cavity or plenum spans approximately the distance between the axis of rotation of the rotors, and up to 1.5 times such distance.

In a second modification/configuration (hereinafter "the Second Mod"), while unlike the first embodiment no plenum is necessarily included (but may and is included as a preferred embodiment, see below), an aperture is however provided at the rear end of the gear compressor, on the bottom of the compressor at an end thereof opposite the high pressure air discharge (ie exit) port of the compressor, which aperture allows fluid communication from the rear interior of the gear compressor to be in communication with high pressure air emanating from the exit port at the opposite end of the compressor, and in further refinement such aperture is aligned in a direction which allows air to flow directly to/form said high pressure discharge port (i) The First Mod In an important further embodiment of the First Mod of the present invention, the provided plenum or cavity at the rear of the compressor is in fluid communication with high pressure fluid which is expelled from a high pressure discharge port.

The feature of a cavity, which is further and in combination with the feature of fluid communication with the discharge port, has been experimentally found to provide significant improvements in efficiency of such gear compressors and superchargers. In particular, such First Mod has been found, particularly at high rpm's, to substantially reduce the amount of work and horsepower otherwise required to compress to a desired pressure an otherwise equal volume of air.

Without being held to the theory of why, particularly at high rpm's, a significant increase in efficiency results from such first modification as broadly described above and more intimately described hereinafter, it is surmised that in the case of providing a cavity as more particularly defined and claimed herein, at high rpm's the helical rotors impart a significant axial momentum component to transferred volumes of air, and energy in such axial momentum is allowed to be preserved when said transferred volume passes into said plenum or cavity at the rear of the compressor and executes a 180° turn and is able to pass and be directed into transferred volumes which are being axially backward towards said discharge port located at the front of the supercharger by the intermeshing lobes on the rotors.

Where the further feature of directing high pressure discharge air is permitted to enter said cavity, it is further surmised that such discharge air serves to partially pressurize transferred volume of air when forced back toward the front of the supercharger by the intermeshing helical rotors, thereby reducing the otherwise sudden inrush of high pressure discharge air at the front end of the compressor to the transferred volumes which negatively impinges on rotor lobes at in a reverse-momentum direction thereby requiring additional energy input to make up for such losses.

Accordingly, in a first broad aspect of the present invention (First Mod), such invention comprises a gear compressor or supercharger for compressing compressible fluids such as air, comprising:

a housing defining first and second mutually adjacent, parallel, elongate overlapping cylindrical chambers, having a front end and a rear end and a low pressure inlet port and a high pressure discharge port thereon;

a pair of juxtaposed rotors (in a preferred embodiment such rotors are "mirror images" of each other, with a first rotor having a helical twist about a respective longitudinal axis, with the other rotor having an equal and opposite helical twist), each disposed in a respective cylindrical chamber and oppositely rotatable, each having a plurality of radially outwardly extending lobes thereon equidistantly circumferentially spaced about a periphery of each rotor and intermeshed along a side thereof with lobes of an opposite rotor of said pair of rotors, each of said lobes on said rotors twisted about a respective longitudinal axis of rotation of each rotor in a helix angle, each helix angle of each of said lobes on a first of said pair of rotors being equal and opposite to said helix angle of each of said lobes on said other of said pair of rotors, said rotors within said respective cylindrical chambers each adapted to transfer volumes of compressible low pressure fluid from said low pressure inlet port via spaces created between walls of said respective cylinder chambers and unmeshed lobes of each rotor to said high pressure outlet port;

said high pressure discharge port situated on a bottom of said gear compressor/supercharger proximate said front end thereof;

said low pressure inlet port situated on a top surface of said gear compressor/supercharger proximate said front end thereof;

a front end wall situated at said front end of said gear compressor/supercharger;

a rear end wall situated at said rear end of said gear compressor/supercharger; and a plenum or cavity at said rear end situated rearwardly of said rotors and below said respective axis of rotation of each of said rotors, which spans at least a distance between said respective longitudinal axis of rotation of each of said rotors.

In a further preferred embodiment of the gear compressor/supercharger of the present invention in its First Mod, the plenum or cavity is further in fluid communication with high pressure fluid which is discharged from said high pressure discharge port.

In a further embodiment of the gear compressor or supercharger of the present invention in its First Mod, piping fluidly connects the plenum or cavity with said high pressure discharge port. In this embodiment it is expressly contemplated that the rear end wall of the compressor have pipe-coupling means thereon in communication with said plenum or cavity, and that the pipe coupling means be adapted to permit fluid communication via piping connected thereto to high pressure fluid exiting from said high pressure discharge port.

In a further embodiment, it is contemplated that the plenum or cavity at the rear end of said gear compressor/supercharger be of a sufficient height so as to span substantially a radial height of each individual lobe of each rotor.

While not necessary to the operation of the compressor/supercharger of the present invention, it is contemplated in a preferred embodiment that an aperture area be provided on a lower point of intersection of said mutually adjacent chambers, proximate said rear end of said gear compressor/supercharger, which aperture is in fluid communication with the plenum or chamber. Such aperture assists in allowing transferred volumes which travel axially rearwardly with angular momentum to thereafter pass into an intermeshing area and thereafter be directed axially forwardly to the high pressure discharge port by the intermeshing of rotor lobes upon rotation thereof. In a preferred embodiment, the aperture area is a 'v'-shaped area, having its largest area proximate said rear end of the gear compressor/supercharger.

(ii) The Second Mod

In the Second Mod a second aperture is provided proximate a rear end of the gear compressor, proximate a bottom surface thereof, which permits fluid communication between an interior of the gear compressor at such rear end and high pressure fluid discharged from said high pressure discharge port proximate a forward end of such gear compressor/supercharger.

In a preferred embodiment of the Second Mod of the present invention, a plenum or cavity is provided at the rear of the supercharger, proximate the second aperture, and in fluid communication with the second aperture, and further in fluid communication with air from the discharge port (first aperture).

Similar to the experimental findings with respect to the First Mod, the feature of the plenum/cavity, at the lower bottom side of the supercharger, in fluid communication with the high pressure discharge port, has been experimentally found to provide significant improvements in efficiency of such gear compressors and superchargers. In particular, such Second Mod, particularly at high rpm's, has been found to substantially reduce the amount of work and horsepower otherwise required to compress to a desired pressure an otherwise equal volume of air.

Without being held to the theory of why, particularly at high rpm's, a significant increase in efficiency results from such Second Mod, it is surmised that in the case of providing the second aperture which is in communication with the first aperture (ie discharge port), at high rpm's the helical rotors impart a significant axial momentum component to transferred volumes of air, and energy in such axial momentum is allowed to be somewhat preserved and shock waves reduced when said transferred volume impacts the rear of the compressor and a portion of suc air executes a 180° turn and is able to pass and be directed via said second aperture into said high pressure discharge port. Similarly reverse shock waves from said high pressure discharge port are permitted to be dissipated by permitting access via the second aperture into lower pressures temporarily existing in the rear of the gear compressor/supercharger. In the Second Mod this benefit can be increased by further providing a plenum or chamber immediately proximate the second aperture, and again serves to further reduce the otherwise sudden inrush of high pressure discharge air at the front end of the compressor to the transferred volumes which negatively impinges on rotor lobes at in a reverse-momentum direction thereby requiring additional energy input to make up for such losses.

Accordingly, in a broad embodiment of the Second Mod, such invention comprises a gear compressor or supercharger for compressing compressible fluids such as air, comprising:

a housing defining first and second mutually adjacent, parallel, elongate overlapping cylindrical chambers, having a front end and a rear end and a low pressure inlet port and a high pressure discharge port thereon;

a pair of juxtaposed rotors, each disposed in a respective of said cylindrical chambers and each oppositely rotatable, each having a plurality of radially outwardly extending lobes thereon equidistantly circumferentially spaced about a periphery of each rotor and intermeshed along a side thereof with lobes of an opposite rotor of said pair of rotors, each of said lobes on said rotors twisted about a respective longitudinal axis of rotation of each rotor in a helix angle, each helix angle of each of said lobes on a first of said pair of rotors being equal and opposite to said helix angle of each of said lobes on said other of said pair of rotors, said rotors within said respective cylindrical chambers each adapted to transfer volumes of compressible low pressure fluid from said low pressure inlet port via spaces created between walls of said respective cylinder chambers and unmeshed lobes of each rotor axially along said respective cylindrical chambers from said front end to said rear end of said gear compressor and then axially back along said gear compressor to a location proximate said front end of said gear compressor and thereafter to said high pressure discharge port;

the high pressure discharge port situated on a bottom surface of said gear compressor proximate the front end thereof;

the low pressure inlet port situated on a top surface of said gear compressor proximate the front end thereof;

divider means situated on a bottom surface of the gear compressor extending substantially from said front end to said rear end of the gear compressor, a first aperture in the divider means proximate the front end which comprises said high pressure discharge port; and a second aperture situated proximate the rear end of said compressor proximate the bottom surface;

the second aperture permitting fluid communication between an interior of said gear compressor at said rear end of said gear compressor and high pressure fluid discharged from said high pressure discharge port.

In a further preferred embodiment the divider means has a substantially linear channel therein to permit fluid to flow between the first aperture and the second aperture, and preferably permitting fluid flow forwardly via said channel in said divider means from the second aperture to the first aperture and/or alternatively permitting fluid flow rearwardly from the first aperture via said channel to the second aperture.

In a further preferred embodiment of the Second Mod, a forward portion of the divider means is arcuately curved upwardly from a horizontal plane which defines the bottom surface of the gear compressor/supercharger so as to provide a raised portion substantially in a middle of the divider means, and a rearward portion of the divider portion is substantially flat and is situated within said horizontal plane. The second aperture is situated intermediate the rearward flat portion and upwardly-curved portion of the divider means, in a plane perpendicularly disposed to the said horizontal plane.

In a still further embodiment of the Second Mod, a plenum or partial cavity is provided at the rear end of said gear compressor, immediately above the rearward substantially flat portion of the divider means. The second aperture is in fluid communication with the plenum. The second aperture permits fluid within said plenum to be in communication with said first aperture (ie high pressure discharge port). It is postulated the further provision of the plenum or cavity advantageously has the effect of increasing or enhancing the effect of the second aperture in reducing shock waves within the fluid created by the rotating rotors, forcing of the fluid first rearwardly and then forwardly, thereby improving the performance of the gear compressor.

BRIEF DESCRIPTION OF THE DRAWINGS

Further advantages and permutations and combinations of the above elements will now appear from the above and from the following detailed description of various non-limiting embodiments of the invention, taken together with the accompanying drawings, in which.

Figure 8:
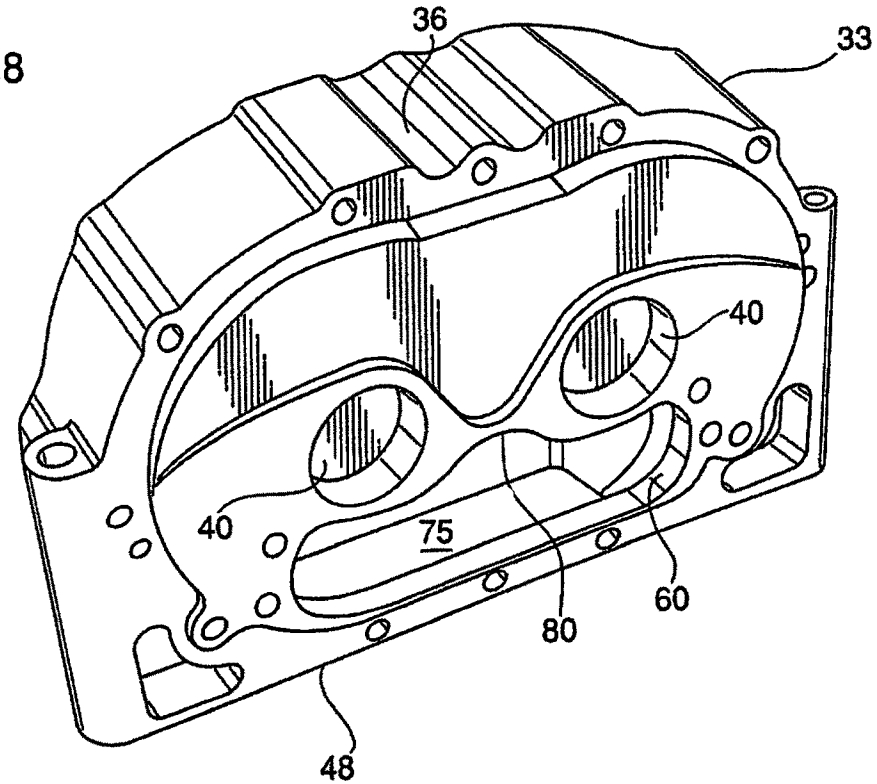
FIG. 8 is a rear perspective view of a second alternative embodiment of the rear end wall for a gear compressor/ supercharger of the present invention (First Mod), having a plenum/cavity in accordance with and in the location shown in accordance with the present invention.
Figure 9:
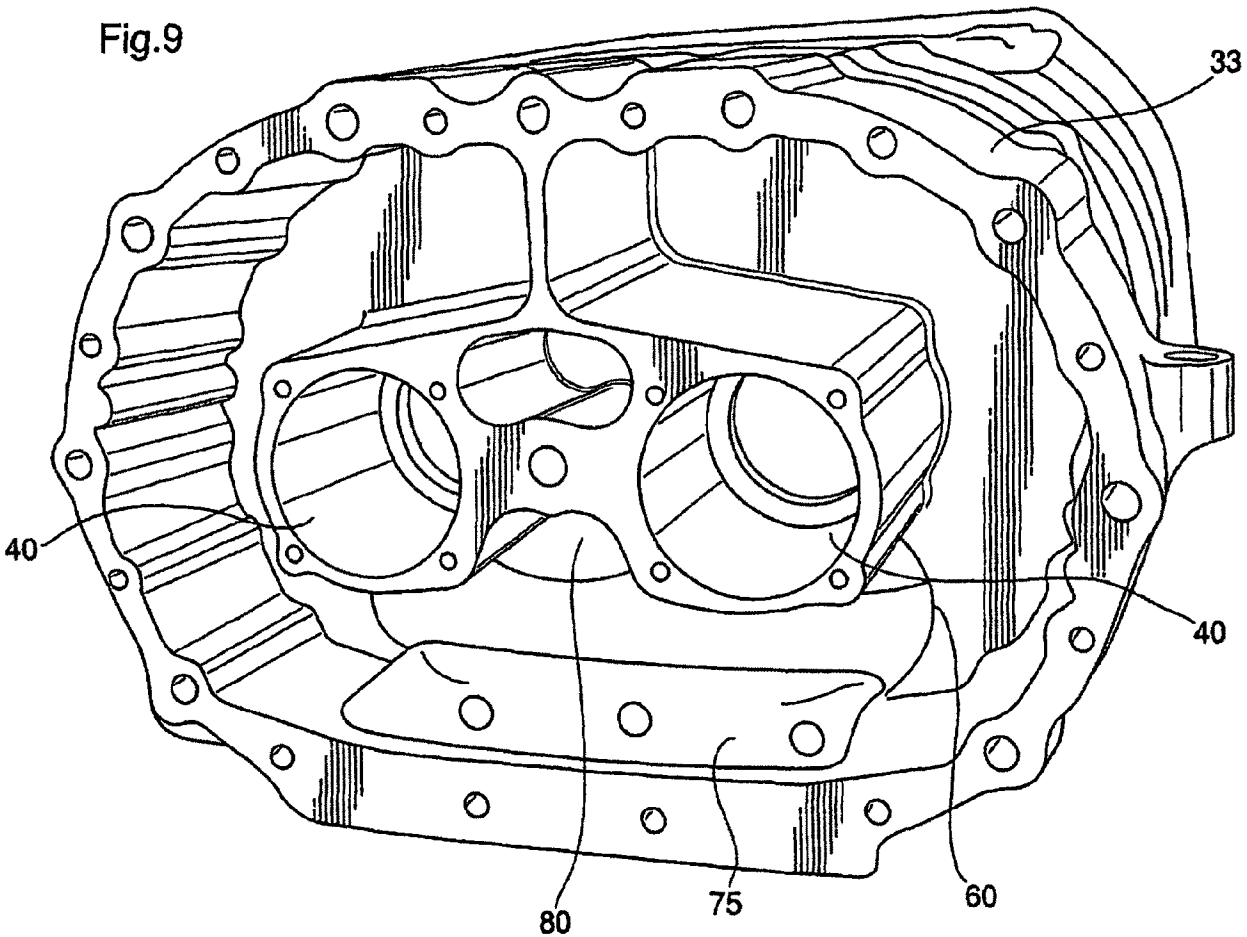
Figure 10:
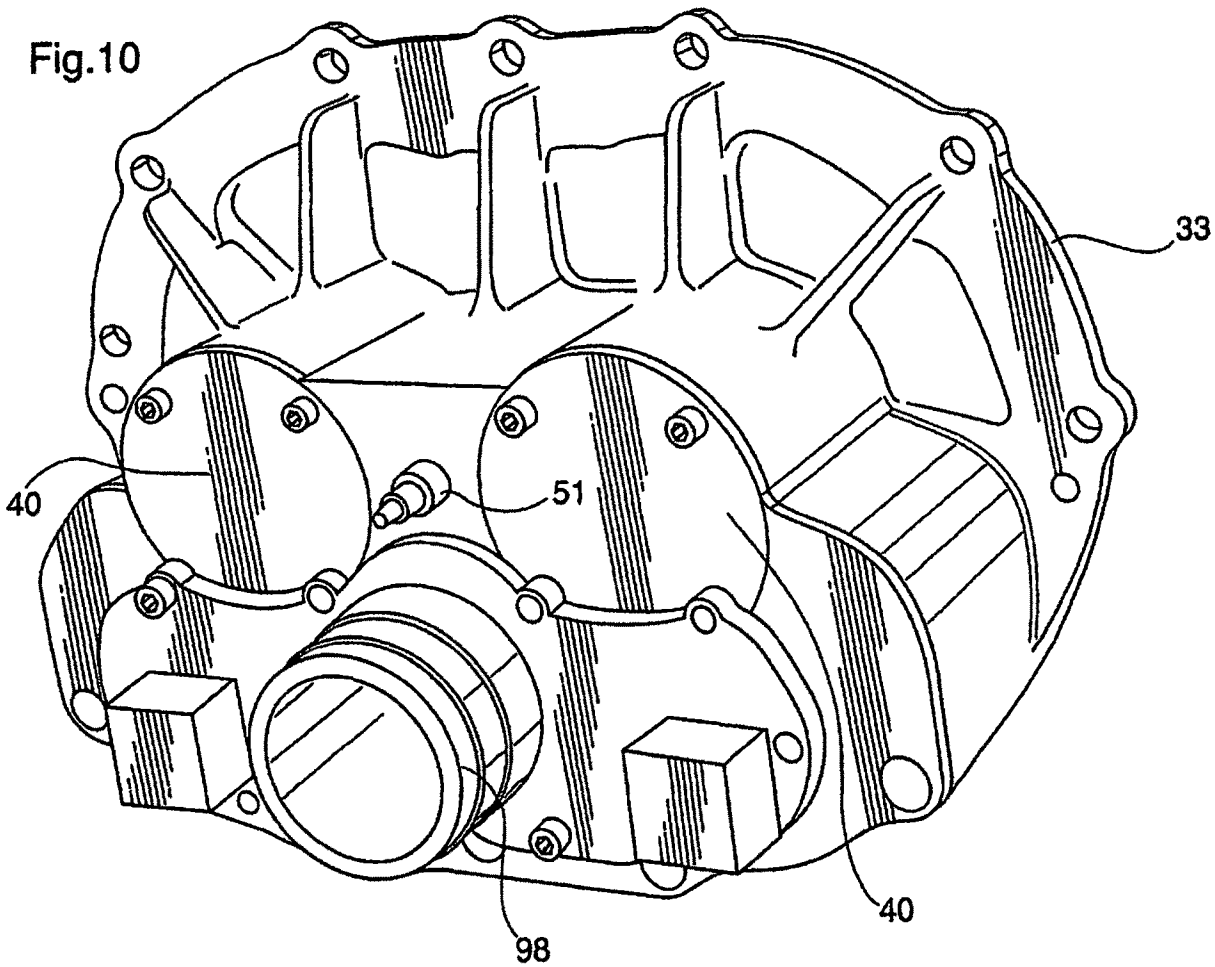
Figure 11:
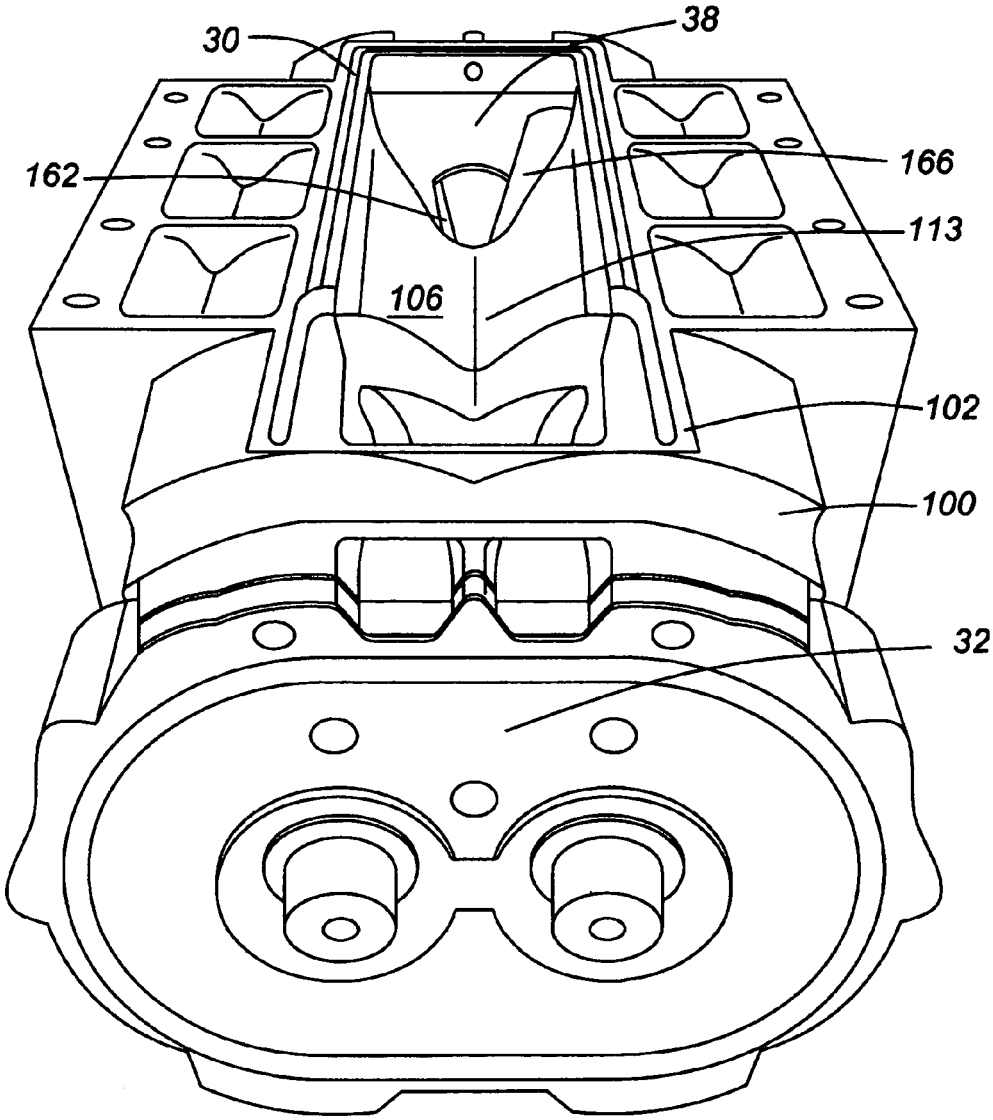
Figure 12:
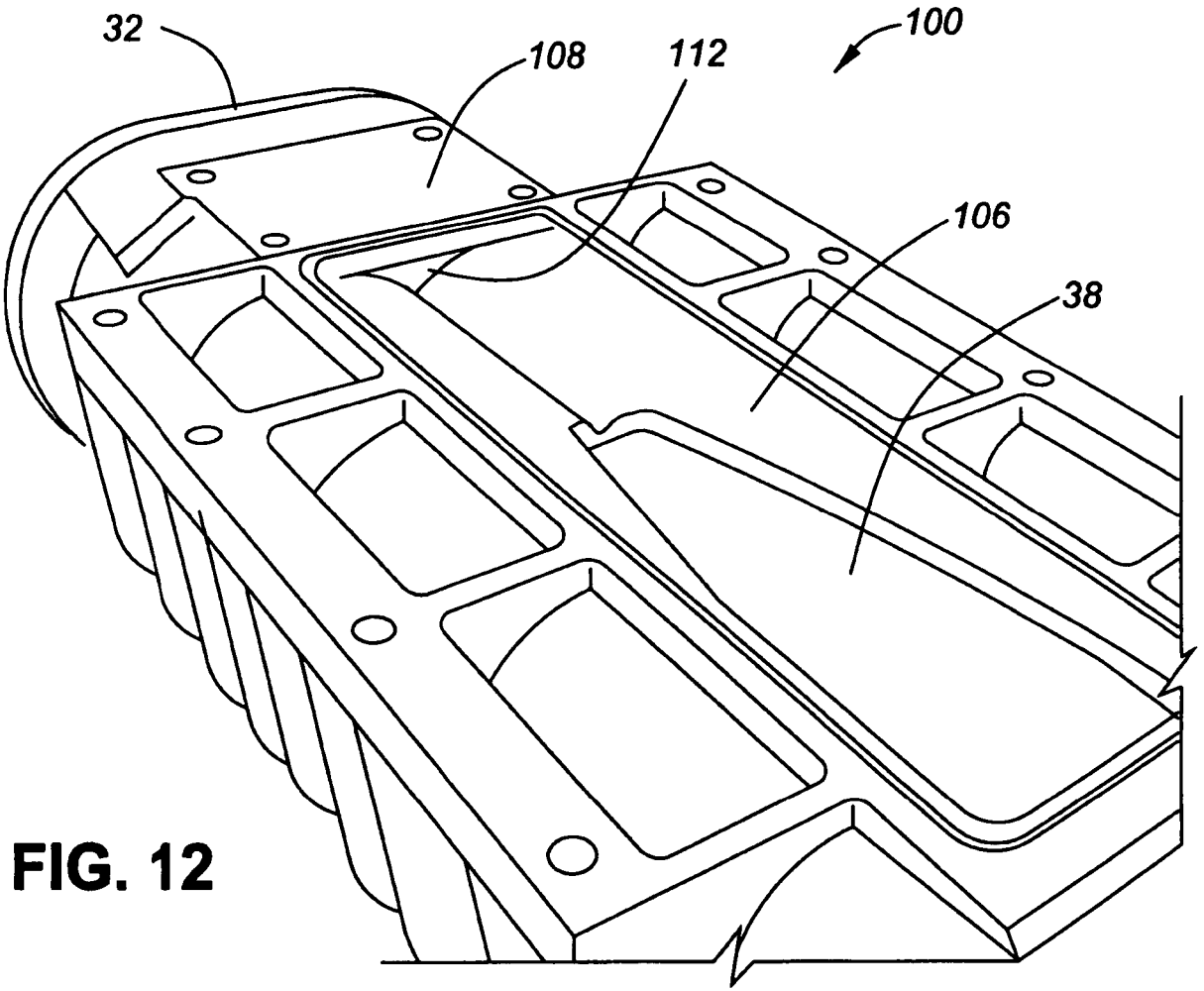
Figure 13:
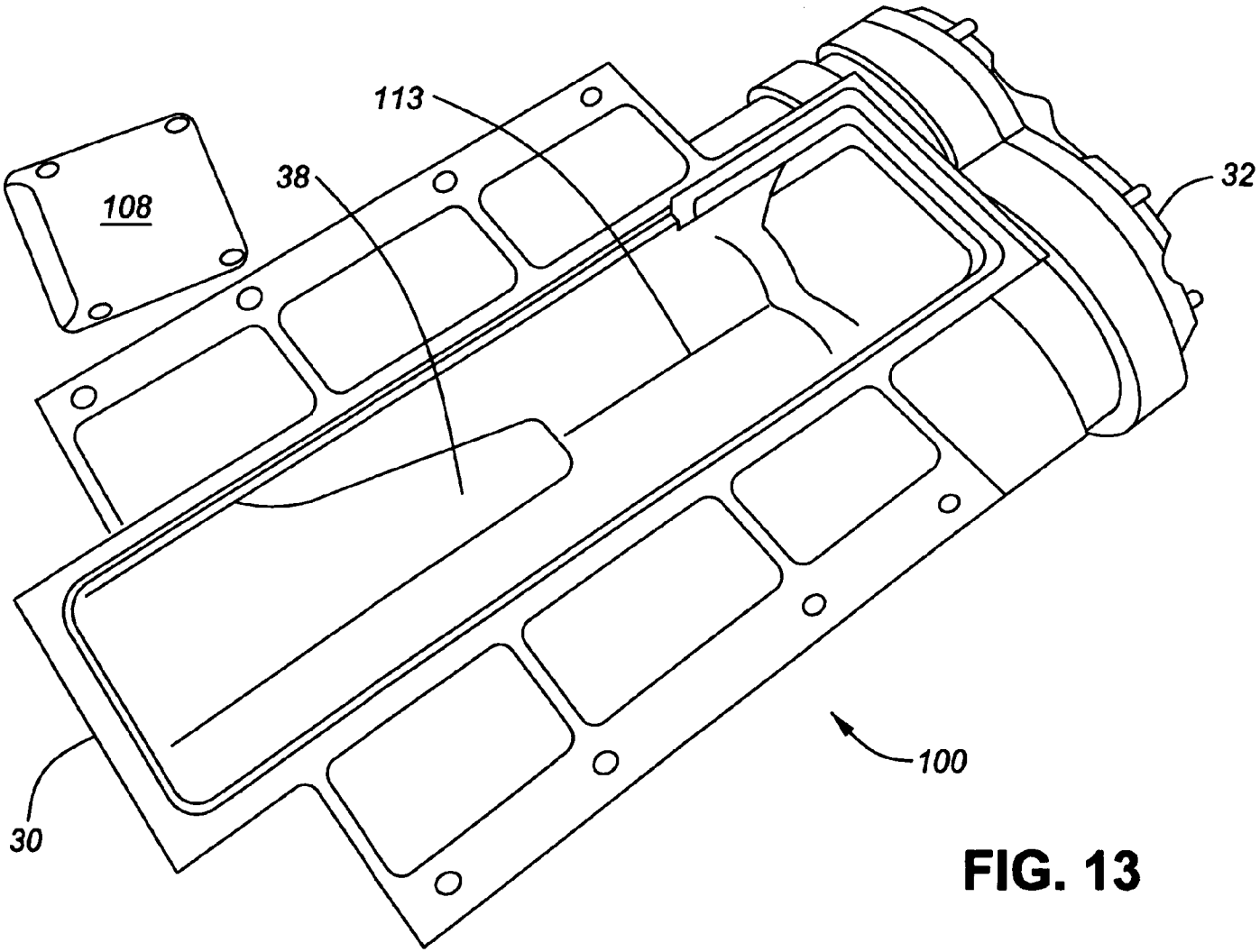
Figure 14:
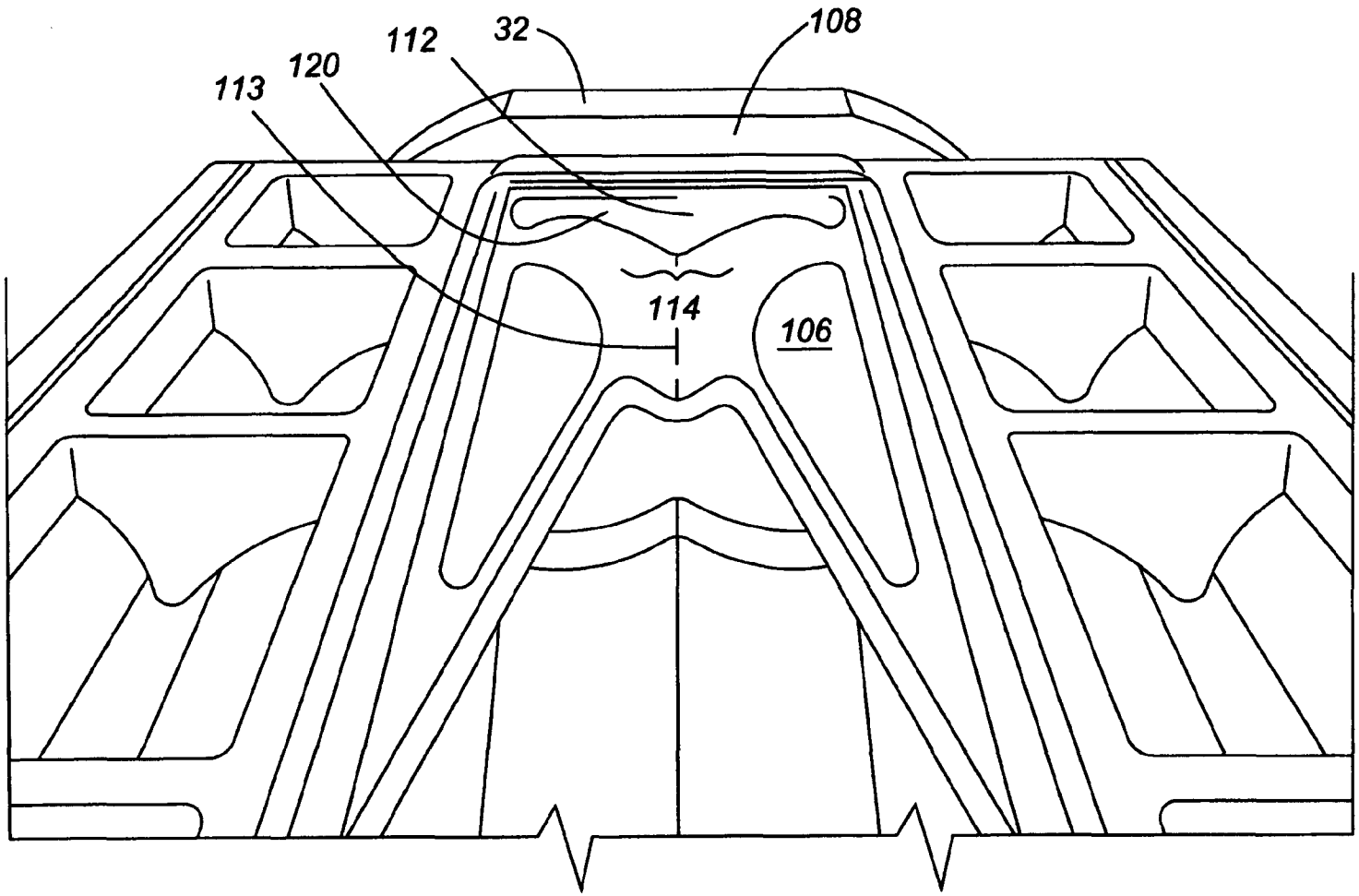
Figure 15:
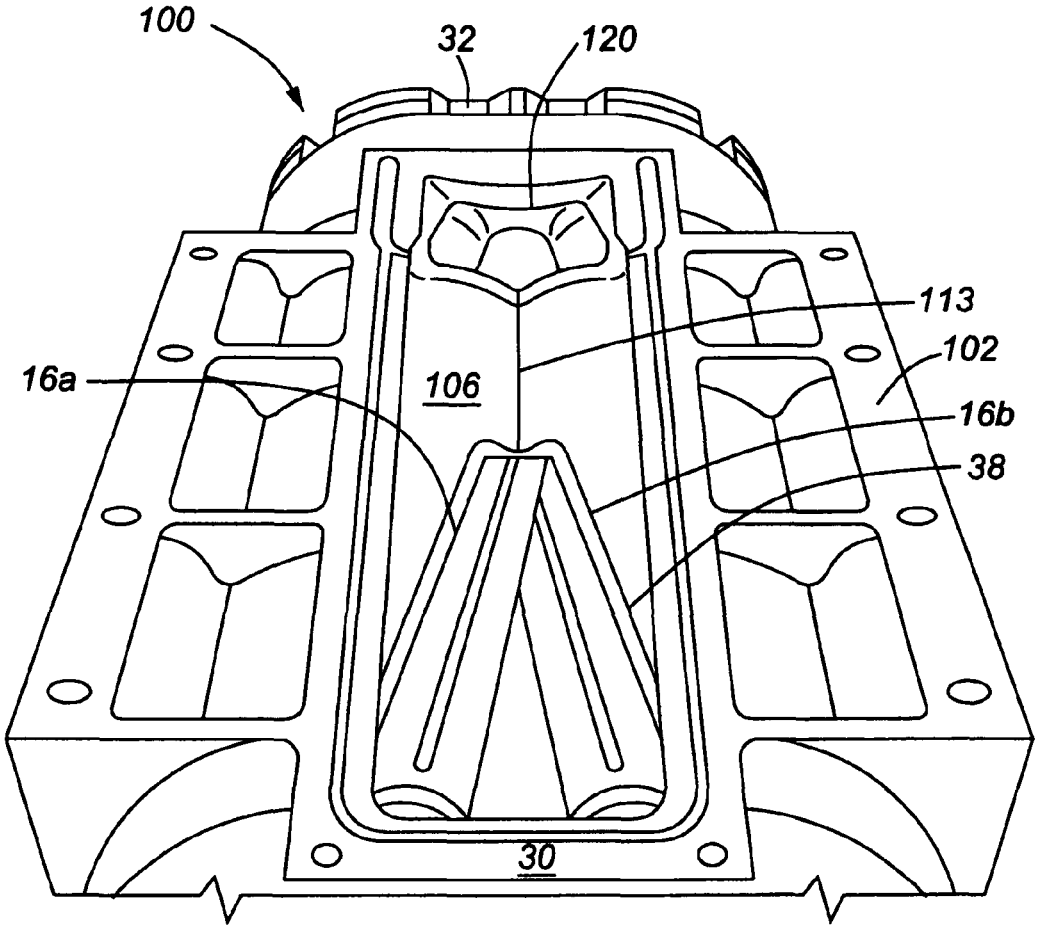

FIG. 9 is a front perspective view of the rear end wall shown in FIG. 8;

FIG. 10 is a rear perspective view of a third alternative embodiment of the rear end wall for a gear compressor/supercharger of the present invention (First Mod), showing pipe coupling means thereon to permit fluid communication with high pressure discharger air from the compressor high pressure discharge port;

FIG. 11 is a bottom perspective view of the gear compressor/supercharger of the present invention (Second Mod), looking forwardly, showing the first and second apertures;

FIG. 12 is a similar bottom perspective view of the gear compressor/supercharger of the present invention (Second Mod), with the rotors removed, showing the divider means, in both its substantially flat rearward portion, and its arcuate upwardly curved forward portion and the horizontally-extending channel is the forward portion thereof;

FIG. 13 is a similar bottom perspective view of the gear compressor/supercharger of the present invention (Second Mod) similar to FIG. 12, with the substantially flat rearward portion of the divider means removed, showing the small plenum formed above;

FIG. 14 is a bottom perspective view of the gear compressor/supercharger of the present invention (Second Mod) looking rearward, with rotors removed, showing the second aperture situated in a plane perpendicularly disposed to the horizontal bottom plane of the supercharger and intermediate the rearward flat portion and the upwardly-curved portions of the divider means and looking into the plenum situated immediately above (below in FIG. 14) the substantially flat portion of the divider means; and FIG. 15 is a bottom perspective view of the gear compressor/supercharger of the present invention (Second Mod) looking rearward, showing the rotors in position, showing the plenum situated proximate the second aperture, and showing the first (high pressure discharge) aperture.

DETAILED DESCRIPTION OF PREFERRED EMBODIMENTS (FIRST MOD)

Figure 1:
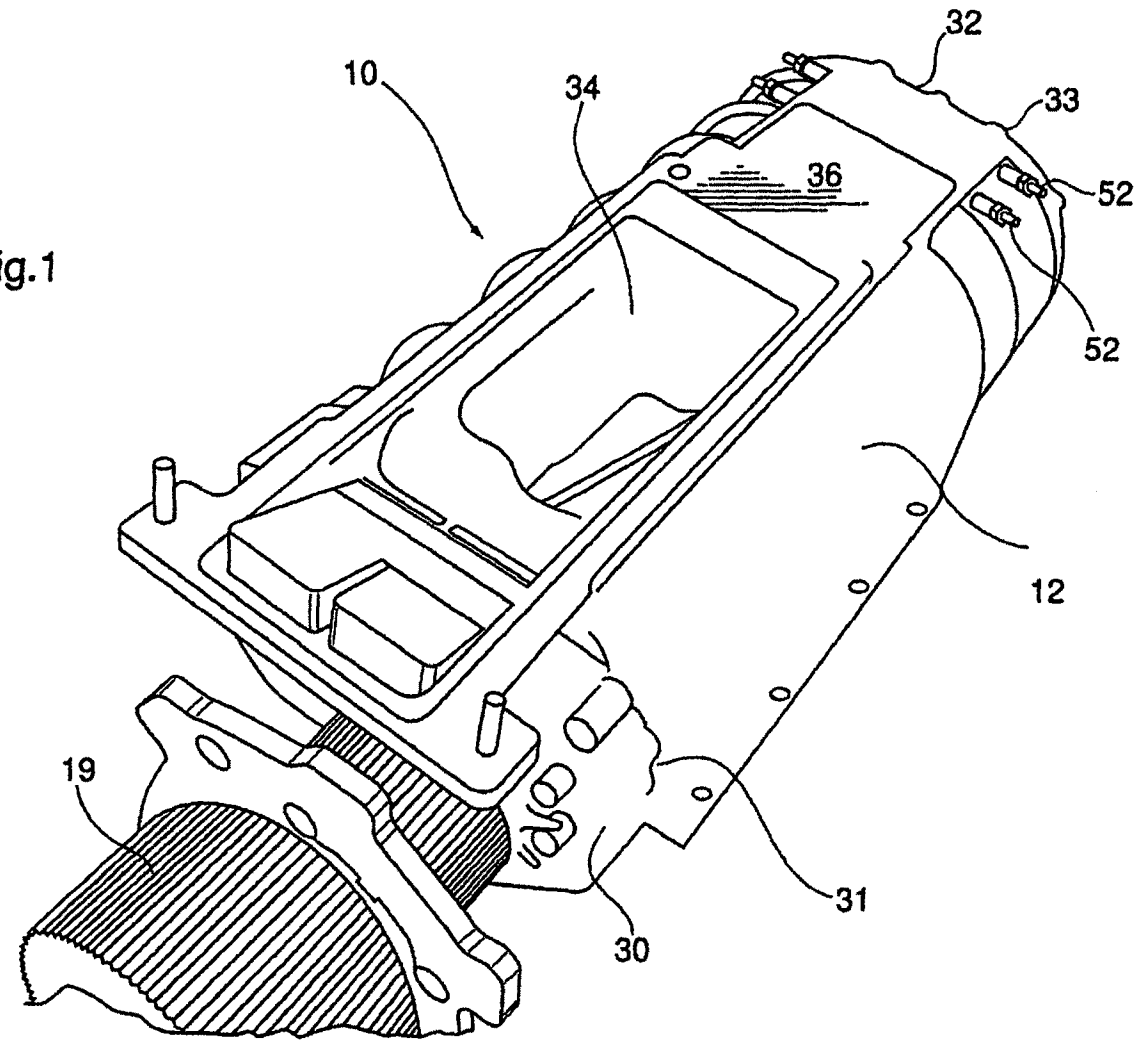
FIG. 1 is a top perspective view of a gear compressor/supercharger of the present invention (First Mod), with the helical gears or rotors removed, looking aft.
Figure 2:
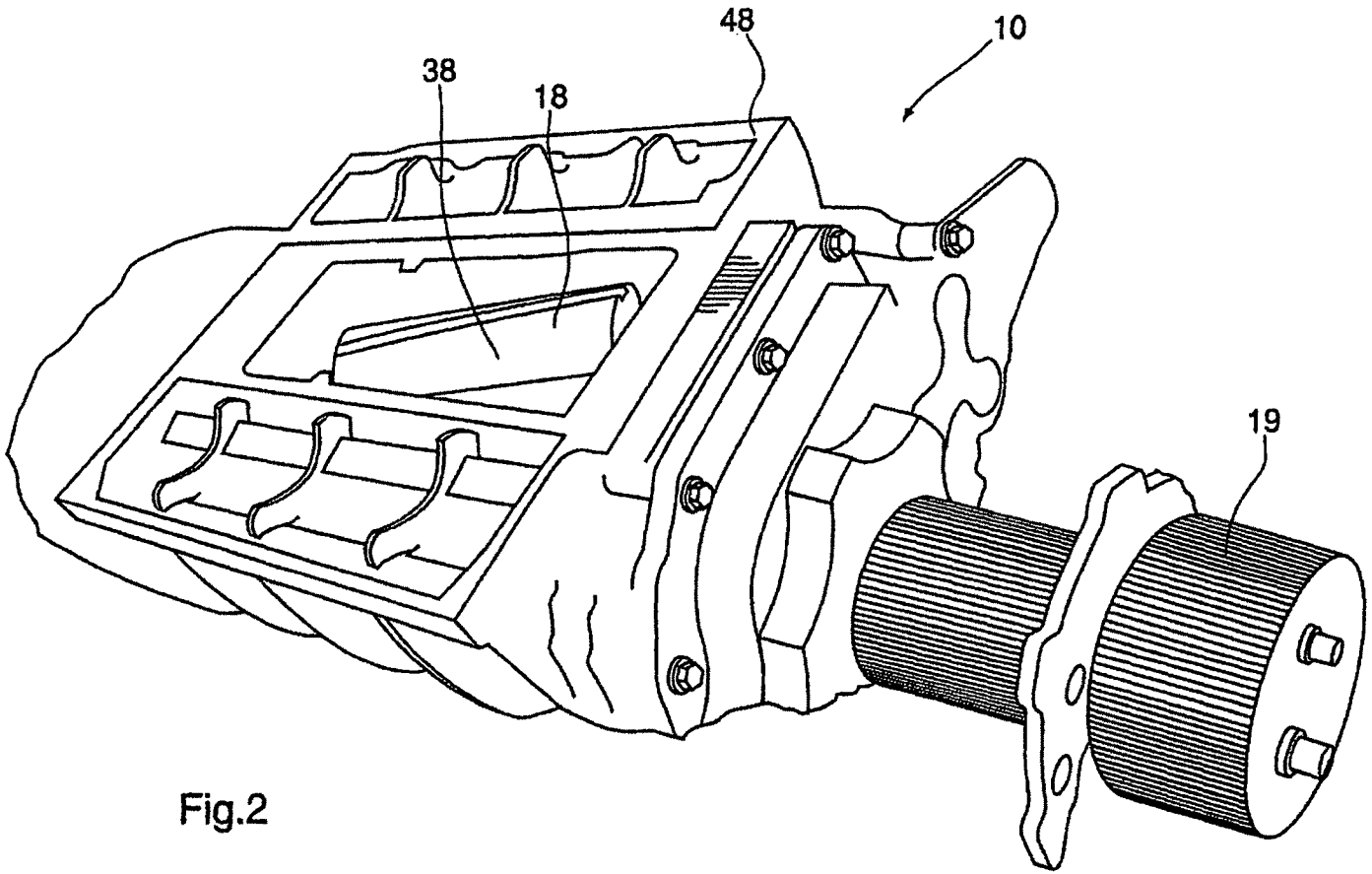
FIG. 2 is a bottom perspective view of a gear compressor/supercharger of the present invention (First Mod), with the helical gears/rotors in operative position.
Figure 3:
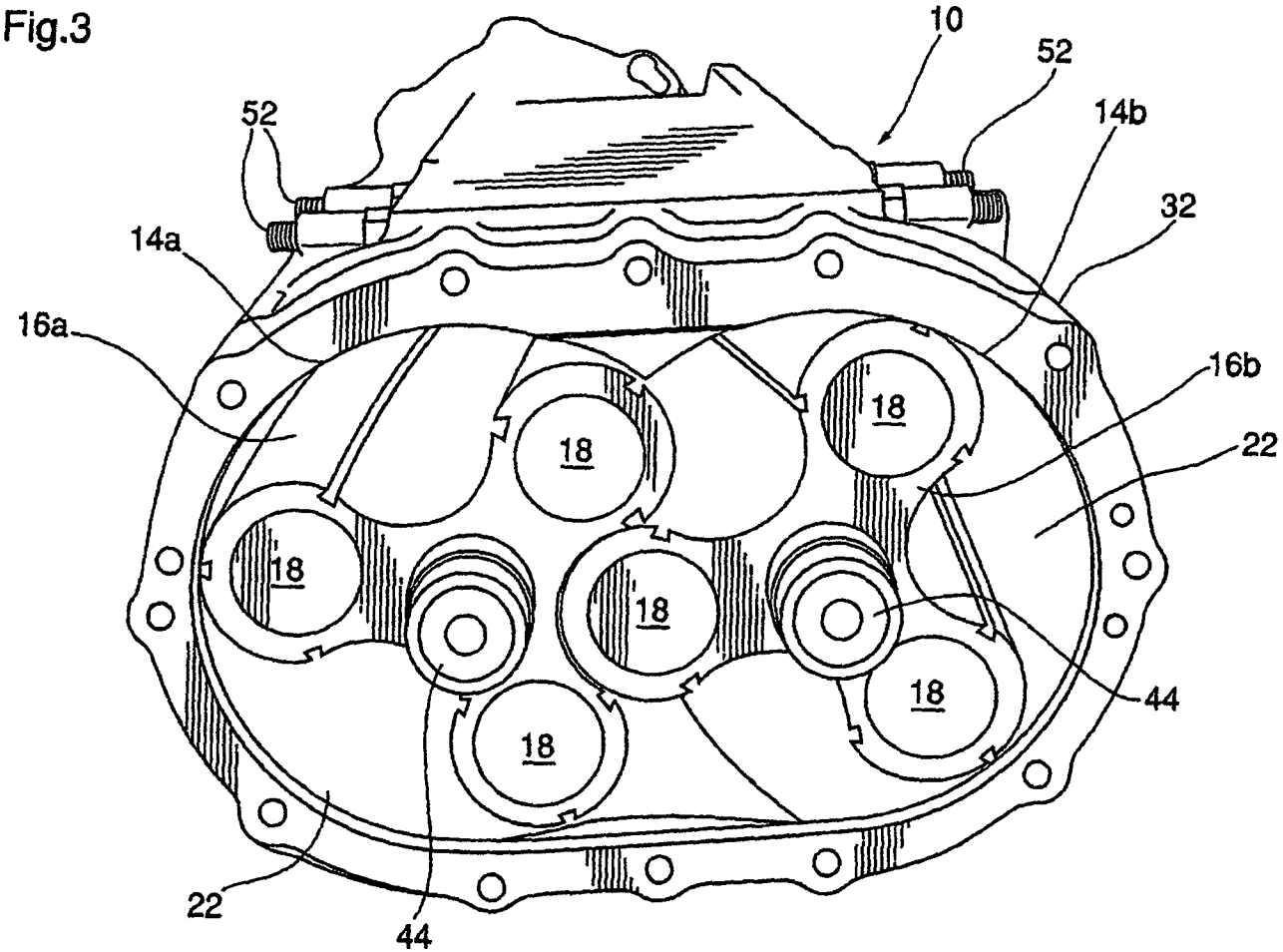
FIG. 3 is rear end view of the gear compressor/supercharger of the present invention, with the rear end wall removed, showing the helical rotors.

FIG. 1 shows a top perspective view of a gear compressor/supercharger 10 of the present invention. FIG. 2 is a bottom perspective view of a gear compressor 10 of the present invention. As seen from FIGS. 1, 2, 3 & 4, gear compressor 10 has a housing 12 which defines first and second mutually adjacent, parallel, elongate overlapping cylindrical chambers 14*a*, 14*b* respectively.

Gear compressor 10 has a front end 30, and a rear end 32, and a front end wall 31, and a rear end wall 33. A toothed drive pulley 19 is provided, to facilitate connection to a drive belt on an internal combustion engine (not shown) on which a gear compressor 10 of this type is typically mounted.

Various NPT pipe connections 51 are provided for allowing supply of lubricating oil to various bearings, such as roller bearings 42 which rotatably support rotatable shafts 44 and on which rotors 16*a*, 16*b* are mounted. Other NPT threaded connections 52 are provided for injecting fuel, to be mixed with air for subsequent supply to an intake manifold (not shown) of an internal combustion engine (not shown) on which the supercharger/gear compressor of the present invention may be mounted.

A low pressure inlet port is 34 typically provided on a top side 36 of such compressor 10, proximate front end 30. A high pressure discharge port 38 is typically provided on a bottom side 48 of compressor 10, likewise proximate front end 30 of compressor 10.

Gear compressor 10 is provided with a pair of juxtaposed substantially identical lobed rotors 16*a*, 16*b*, each disposed in a respective cylindrical chamber 14*a*, 14*b*, each having a plurality of radially outwardly extending lobes 18 thereon. Lobes 18 are equidistantly circumferentially spaced about a periphery of each rotor 16*a*, 16*b*, and intermeshed along a side thereof with the lobes 18 of an opposite rotor 14*b* of said pair of rotors 16*a*, 16*b*. Each of the lobes 18 on rotors 16*a*, 16*b* are twisted about a respective longitudinal axis of rotation 20 of each rotor 16*a*, 16*b* in a helix angle, each helix angle of each of said lobes 18 on a first rotor 16*a* of said pair of rotors 16*a*, 16*b*, being equal and opposite to said helix angle of each of said lobes 18 on said other rotor 16*b* of said pair of rotors 16*a*, 16*b*. Rotors 16*a*, 16*b* within respective cylindrical chambers 14*a*, 14*b* are each adapted to transfer volumes 22 of compressible low pressure fluid from low pressure inlet port 34 via transfer volumes 22 created between walls of said respective cylinder chambers 14*a*,14*b* and unmeshed lobes 18 of each rotor 16*a*,16*b*, and axially along said respective cylindrical chambers 14*a*,14*b* from said front end 30 to rear end 32 of said gear compressor 10 and then axially back to a location proximate front end 30 of said gear compressor 10 and thereafter to high pressure discharge port 38.

Figure 5:
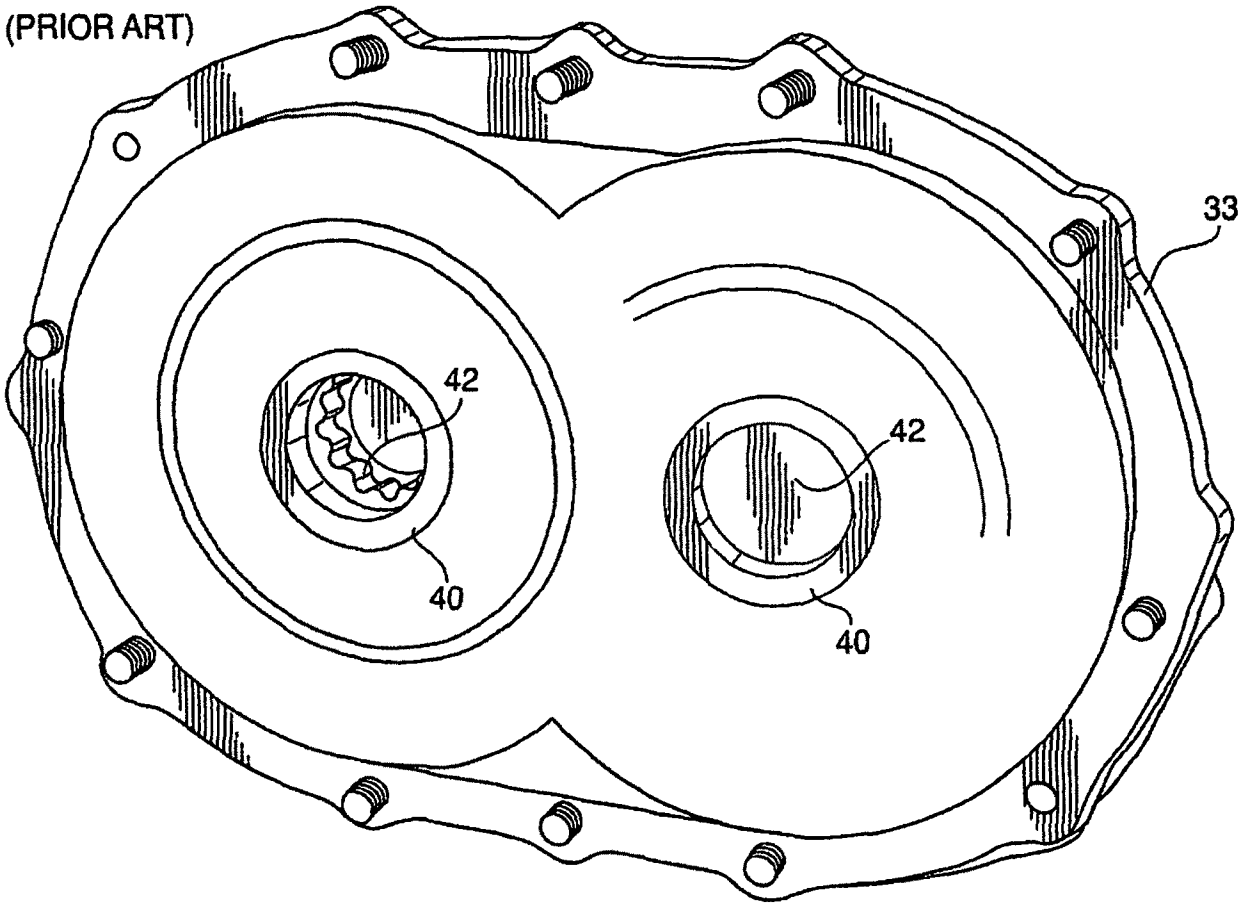
Fig.5 (PRIOR ART)
FIG. 5 is a view of the rear end wall of a helical gear compressor of the prior art.
Figure 6:
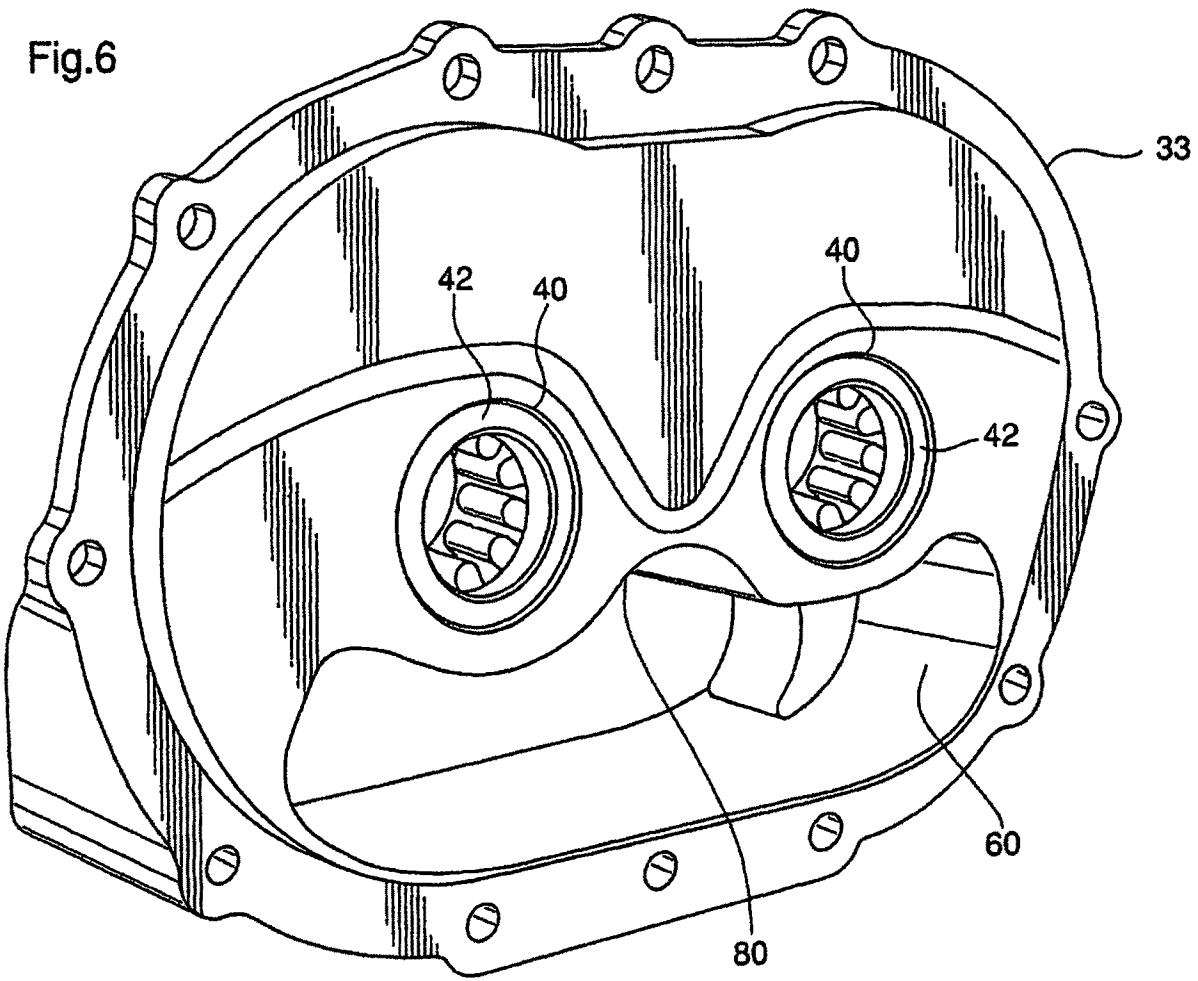
FIG. 6 is a side perspective view of a first embodiment of rear end wall for a helical gear compressor/supercharger (First Mod) of the present invention, having a plenum/cavity in accordance with and in the location shown in accordance with the present invention.
Figure 7:
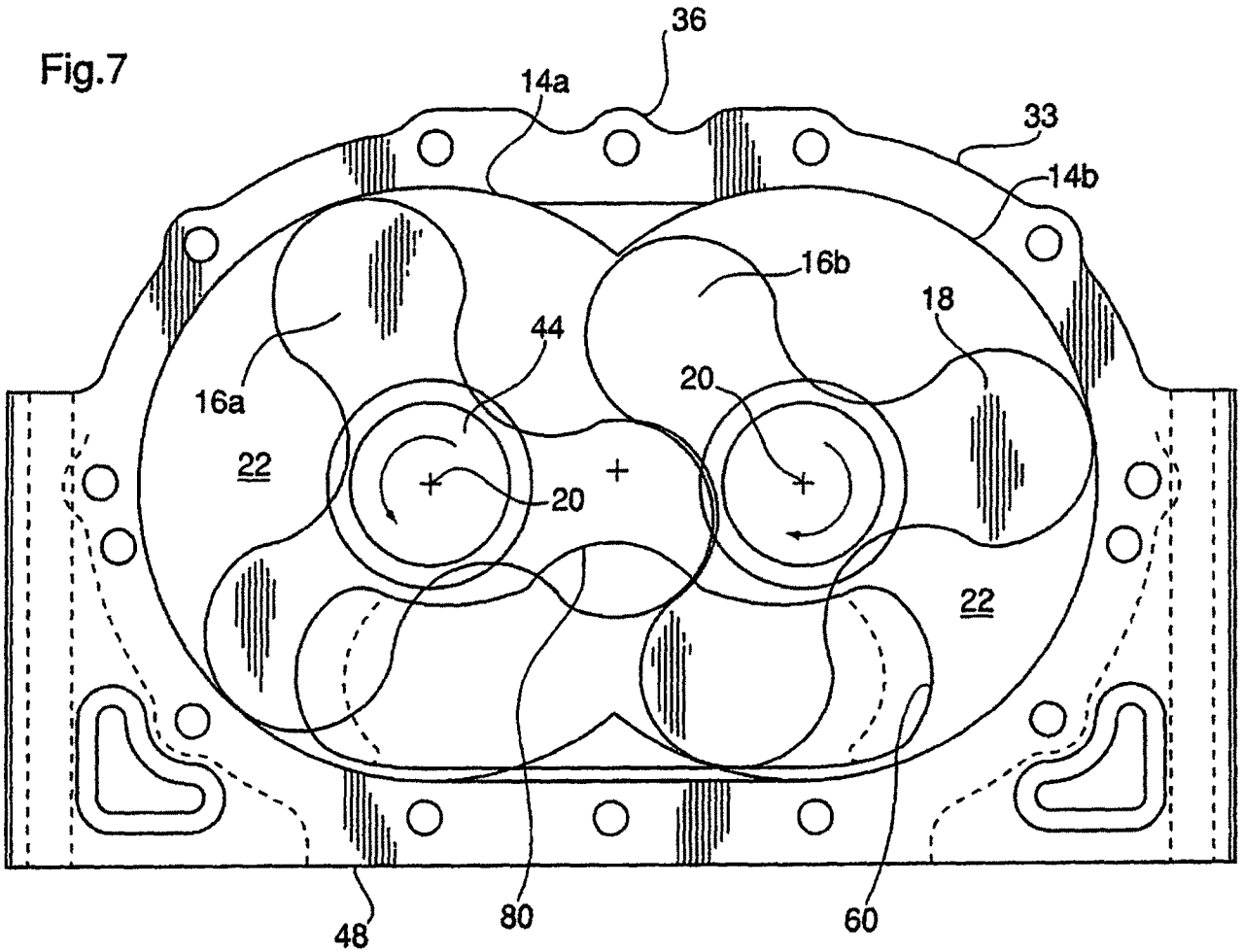
FIG. 7 is a schematic rear end view of the gear compressor/supercharger of the present invention (First Mod), with the location of the cavity/plenum superimposed thereon.

In comparison with rear end walls 33 of compressors 10 of the prior art (see FIG. 5), wherein such prior art rear end walls 33 are typically substantially flat and merely posses a pair of bearing housing recesses 40 for housing roller bearings 42 (se FIG. 5), rear end wall 33 of the present invention in each of the various embodiments shown in FIGS. 6-10 hereto possess not only bearing housing recesses 40 for mounting roller bearings 42 therein which support shafts 44 on which each of rotors 16*a*, 16*b* are mounted, but further possess a plenum or cavity 60. Cavity/plenum 60, when said rear end wall 33 is mounted on the rear end 32 of compressor 10, is situated rearwardly of said rotors 16*a*, 16*b*, and below said respective axis of rotation 20 of each of said rotors 16*a*, 16*b*. Cavity/plenum 60 preferably spans approximately a distance between said respective longitudinal axis of rotation 20 of each of said rotors 16*a*, 16*b*, as best seen in FIG. 7, and up to 1.5 times such distance.

The height of such cavity 60, and more particularly the height of aperture 75 in rear end wall 33, is such that such aperture extends in height from a lowermost point of travel of the path of the rotating rotors 16*a*, 16*b* (see FIG. 7), up to a height no greater than the level of respective axis of rotation 20 of such rotors 16*a*, 16*b*, to avoid otherwise creating leakage of pressurized air back to the air inlet manifold 34. The cavity 60 rearwardly of such aperture 75, as shown in FIG. 9, may of course extend higher without thereby creating such a negative leakage problem.

As more fully set out below, it has been experimentally found that the provision of cavity or plenum 60 in rear end wall 33 which is continually exposed to ends of rotors 16*a*, 16*b* provides an unexpected increase in efficiency of helical compressors 10 of the type described and shown herein.

Specifically, without being limited to such explanation, it is surmised that at high rotational speeds of helical rotors 16*a*, 16*b* the lobes 18 thereof, due to the helical twist angle which may range between 50 to 130°, impart a significant axial momentum component to transferred volumes 22 of air. Energy in such axial momentum is allowed to be preserved when each said transferred volume 22 passes into said plenum or cavity 60 at the rear end 32 of the compressor 10 and executes a 180° turn and is directed and then forced axially backward towards said discharge port located at the front end 30 of the compressor/supercharger 10 by the intermeshing lobes 18 on the rotors 16*a*, 16*b*.

In a first embodiment of the rear end wall 33 of the present invention shown in FIG. 6, a simple cavity 60 is provided in rear end wall 33. Upper extremities thereof are generally arcuate, as best shown in FIGS. 6 & 7, so as to allow retention of bearings 42 in bearing housings 41 and also preferably not to extend above axis of rotation 20 of rotors 16*a*, 16*b*, as such would otherwise allow significant "bleeding" or leakage of transferred volumes 22 of air to the air inlet side (ie the upper side of rotors 16*a*, 16*b*, namely that portion above the axis of rotation 20 thereof). Such cavity may extend completely through rear end wall 33, thereby offering the option of simply "blanking off" a back side of rear end wall 33, or permit bolting or attachment of a similar additional end wall likewise having a cavity 60 therein, which allows the effective size and volume of such plenum/cavity to thereby be increased if so desired.

In a second embodiment of the rear end wall 33 for the novel gear compressor 10 of the present invention, as shown in FIG. 8 (front view) and FIG. 9 (rear view), such rear end wall 33 may be of a casting, which allows greater volume of cavity/plenum 60 rearwardly of curved aperture 80.

In a preferred embodiment, as shown in each of the two embodiments of the rear end wall 33 (such two embodiments shown in FIG. 6, and FIGS. 8 & 9 respectively), such plenum/cavity 60 is in fluid communication with high pressure fluid discharged from the high pressure discharge port 38 of compressor 10. In this regard, for the rear end wall 33 shown in FIG. 6 and FIGS.'8 & 9, a further lower aperture 75 is provided, typically on an underside of rear end wall 33, which allows for connection to high pressure air from the high pressure discharge port 38. Such further aperture may be coupled via piping to the air inlet of an internal combustion engine on which the compressor 10 is mounted, or may be coupled to the high pressure discharge outlet 38 of compressor 10.

In a third embodiment of the rear end wall 33 of the present invention (see FIG. 10 hereto), in place of lower aperture 75 such rear end wall 33 has pipe coupling means 98 in communication with the plenum/cavity 60, which pipe coupling means 98 is adapted to permit high pressure air from high pressure discharge port 38 to be directed to plenum/cavity 60 and thence to transfer volumes 22.

Figure 4:
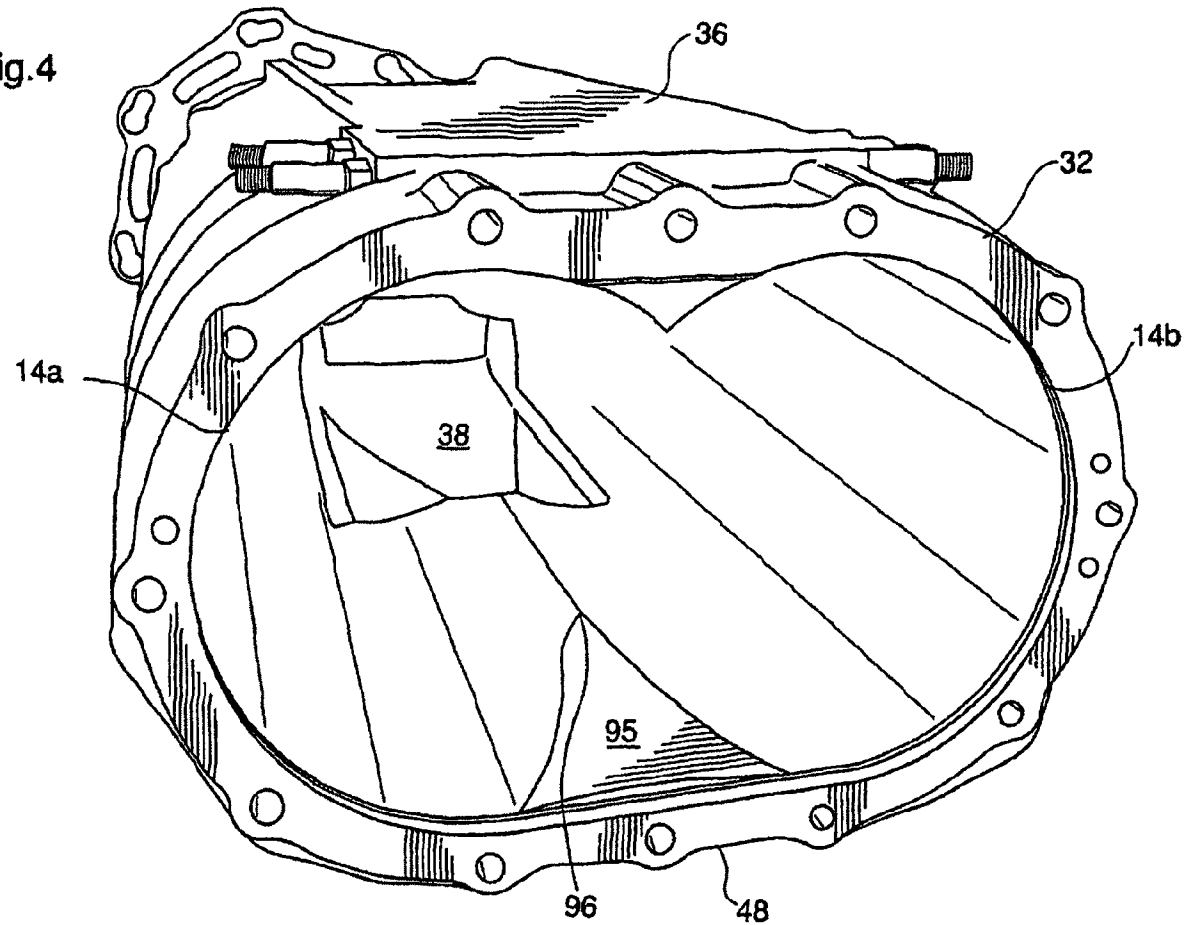
FIG. 4 is a rear end view of the gear compressor/supercharger of the present invention (First Mod) with the rear end wall removed and similar to the view shown in FIG. 3, but with the rotors removed.

While not necessary to the operation of the invention, it is recommended that there be provided an aperture area 95 on a lower point of intersection 96 of cylindrical chambers 14*a*, 14*b* and proximate the rear end 32 of gear compressor 10, as shown in FIG. 4. Such aperture area 95 is in fluid communication with plenum 60, and is recommended for the purpose of assisting in more uniform air flow from cavity 60 back to rotors 16*a*, 16*b* for subsequent delivery by rotors 16*a*, 16*b* to high pressure discharge port 38.

The invention herein is particularly suited to a modification of a Roots-type gear compressor 10 similar to those manufactured by manufactured by Kobelco Compressors (America) Inc., exclusively distributed by DPME Inc. of Stevensville, Ind. and others of similar manufacture, which are of the "backflow" type, where air is drawn in at a location proximate the front end 30 thereof and proximate top side 36 of the compressor 10, and which by operation of rotating helical rotors 16*a*, 16*b* is directed downwardly and axially rearwardly within the gear compressor 10 towards the rear end wall 33 of the compressor 10, wherein upon reaching the rear end wall 33 of compressor 10, is forced back via operation of the rotating helical lobes 18 on said rotors 16*a*, 16*b* towards the front end 30 of the compressor 10 and then and forcefully expelled from a high pressure discharge port 38 situated on the side 40 of the compressor 10 towards the front end 30 of such compressor 10. However, other similar gear compressors 10 of different manufacture are suitable for the modification of the present invention for the purpose of increasing the efficiency thereof. Alternatively original manufacture of a gear compressor 10 of the present invention is contemplated.

EXAMPLE 1

In order to evaluate efficiency increases to gear compressors and supercharger arising from the inventive modifications herein described and claimed, a standard prior art supercharger was tested to provide a base comparison.

Accordingly, for this purpose a publicly available model 14/71 standard helix supercharger manufactured by Kobelco Compressors (America) Inc. of Elkhart, Ind., exclusively distributed by DPME Inc. of Stevensville Mich., part number KS14S2LS, having a pair of helical 3-lobe rotors, each with a standard (but opposite) 60° helix angle per 15 inch rotor length, was used.

Such standard model 14/71 supercharger was inter alia modified to mill an aperture area 95 on a lower point of intersection 96 of mutually adjacent rotor chambers 14*a*, 14*b* thereof proximate the rear end 32 of the supercharger 10, commencing at about 1.5 inches from a rear wall thereof, to a maximum depth proximate the rear end of approximate 0.75 inches. Such supercharger via a gearbox thereon provided a gear reduction from engine RPM to supercharger rotor rpm of 1.102 to 1.

For the purpose of the tests conducted herein, such model 14/71 supercharger was mounted on a modified 369 cubic inch BAE Chrysler 8 cylinder methanol fueled engine (not shown). A dynamometer test was run to determine horsepower produced at various RPM's for such engine, having on the inlet manifold of such engine the above model 14/71 supercharger mounted thereon.

Set out below in Table 1 is a tabulation of horsepower generated by such supercharged Chrysler engine, running at 79 degrees F. ambient air conditions, with a relative humidity of 31%, and a SEA correction factor of 1.1819.

TABLE 1

| ENGINE RPM (Engine RPM × 1.102 = supercharger rotor rpm) | Horsepower Generated |
|---|---|
| 6600 | 1303.8 |
| 6800 | 1378.2 |
| 7000 | 1434.7 |
| 7200 | 1496.7 |
| 7400 | 1522.2 |
| 7600 | 1532.6 |
| 7800 | 1551.5 |
| 8000 | 1529.7 |
| 8200 | 1543.2 |
| 8400 | 1540.2 |
| 8600 | 1550.4 |
| 8800 | 1594.9 |
| 9000 | 1619.9 |
| 9200 | 1656.9 |
| 9400 | 1600.3 |

EXAMPLE 2

Above model 14/71 Kobelco supercharger was modified to replace stock rear cover (end wall) with a rear end wall 33 having a cavity/plenum 60 of the present invention, of relative dimensions as shown in drawings FIG. 6 hereto.

In particular, the cavity/plenum 60 in modified rear end wall member 33 was situated below the axis of rotation 20 of each of rotors 16*a*, 16*b*, and was of a length slightly greater than the distance between the respective axis of rotation 20 of each of said rotors 16*a*, 16*b*, as seen from FIG. 6 hereto. For the purpose of this test run, as regards the lower aperture 75 in rear end wall member 33, such was for this test run "blocked off" by affixing a blanking plate, so as to prevent fluid communication with air discharged from the high pressure discharge port 38 of the supercharger 10. The volumetric size of cavity/plenum 60 utilized in rear end wall of FIG. 6 with lower aperture 75 blanked off was approximately 8.6 cubic inches.

The identical 369 BAE Chrysler engine, having the aforesaid Kobelco supercharger mounted thereon but with modified rear end wall 33 mounted thereon as described above and shown in FIG. 6, was again run at various RPM. Operating conditions were substantially identical to those in Example 1, namely ambient temperature 79 degrees F., relative humidity 31%, SEA correction factor 1.18. The generated horsepower was recorded at such various RPM, with the results tabulated in Table 2 below:

TABLE 2

| Engine RPM (Engine RPM × 1.102 = Supercharger RPM | Horsepower Generated | % Change in Horsepower Generated over Ex. 1 |
|---|---|---|
| 6600 | 1334.3 | +2.3% |
| 6800 | 1399.4 | +1.5% |
| 7000 | 1430.3 | −0.3% |
| 7200 | 1525.8 | +1.9% |
| 7400 | 1566.5 | +2.9% |
| 7600 | 1624.3 | +6.0% |
| 7800 | 1681.7 | +8.4% |
| 8000 | 1692.9 | +10.7% |
| 8200 | 1727.6 | +11.9% |
| 8400 | 1748.8 | +13.5% |
| 8600 | 1772.3 | +14.3% |
| 8800 | 1794.5 | +12.5% |
| 9000 | 1796.8 | +10.9% |
| 9200 | 1797.9 | +8.5% |
| 9400 | 1800.8 | +12.5% |

EXAMPLE 3

Above model 14/71 Kobelco supercharger was further modified to replace the modified end wall as shown in FIG. 6 with a further modified rear end wall, as shown in FIGS. 8 & 9, having a cavity/plenum 60 of relative dimensions as shown in FIGS. 8 & 9 hereto.

Again, the cavity/plenum 60 in modified rear end wall member 33 was situated below the axis of rotation 20 of each of rotors 16*a*, 16*b*, and was of a length slightly greater than the distance between the respective axis of rotation 20 of each of said rotors 16*a*, 16*b*, as seen from FIG. 9 hereto. Again, for the purpose of this test run, as regards the lower aperture 75 in rear end wall member 33, such was for this test run "blocked off" by affixing a blanking plate, so as to prevent fluid communication with air discharged from the high pressure discharge port 38 of the supercharger 10. The volumetric size of cavity/plenum 60 utilized in rear end wall 33 of FIG. 9 with lower aperture 75 blanked off was approximately 14.7 cubic inches.

The identical 369 BAE Chrysler engine, having the aforesaid Kobelco supercharger mounted thereon but with modified end wall mounted thereon as described above, was again run at various RPM. Operating conditions were substantially identical to those in Examples 1 & 2, namely ambient temperature 77 degrees F., relative humidity 40%, SEA correction factor 1.19. The generated horsepower was recorded at such various RPM, with the results tabulated in Table 3 below, showing comparison (% improvement) over the results obtained in Table 1 with the unmodified supercharger configuration:

TABLE 3

| Engine RPM (Engine RPM × 1.102 = Supercharger RPM | Horsepower Generated | % Change in Horsepower Generated over Ex. 1 |
|---|---|---|
| 6600 | 1289.5 | −1.1% |
| 6800 | 1378.0 | 0 |
| 7000 | 1432.3 | −0.2% |
| 7200 | 1519.0 | +1.5% |
| 7400 | 1563.3 | +2.7% |
| 7600 | 1613.3 | +5.3% |
| 7800 | 1684.4 | +8.6% |
| 8000 | 1691.8 | +10.6% |
| 8200 | 1691.0 | +9.6% |
| 8400 | 1744.7 | +13.3% |
| 8600 | 1772.6 | +14.3% |
| 8800 | 1821.1 | +14.2% |
| 9000 | 1861.4 | +14.9% |
| 9200 | 1825.4 | +10.2% |
| 9400 | 1837.4 | +14.8% |

EXAMPLE 4

Above model 14/71 Kobelco supercharger was further modified to replace the modified rear end wall 33 as shown in FIG. 9 with a further modified rear end wall 33, as shown in FIG. 10, having a cavity/plenum of relative dimensions as shown in FIG. 9 hereto.

Again, the cavity/plenum 60 in modified rear end wall 33 was situated below the axis of rotation 20 of each of rotors 16*a*, 16*b*, and was of a length slightly greater than the distance between the respective axis of rotation 20 of each of said rotors 16*a*, 16*b*, as seen from FIG. 9 hereto. For the purpose of this test run, fluid coupling port (ie pipe coupling means 98) as shown in FIG. 10 was directly coupled to the intake manifold of the Chrysler engine, so that such plenum 60 received and was in fluid communication with high pressure air discharged from the high pressure discharge port 38 of the supercharger 10.

The identical 369 BAE Chrysler engine, having the aforesaid Kobelco supercharger 10 mounted thereon but with modified rear end wall 33 mounted thereon as described above, was again run at various RPM. Operating conditions were substantially identical to those in Examples 1 & 2, namely ambient temperature 77 degrees F., relative humidity 40%, SEA correction factor 1.19. The generated horsepower was recorded at such various RPM, with the results tabulated in Table 4 below, showing comparison (% change) over the results obtained in Table 1 with the unmodified supercharger configuration:

TABLE 4

| Engine RPM (Engine RPM × 1.102 = Supercharger RPM | Horsepower Generated | % Change in Horsepower Generated over Ex. 1 |
|---|---|---|
| 6600 | 1348.5 | +3.4% |
| 6800 | 1401.6 | +1.7% |

TABLE 4-continued

| Engine RPM (Engine RPM × 1.102 = Supercharger RPM | Horsepower Generated | % Change in Horsepower Generated over Ex. 1 |
|---|---|---|
| 7000 | 1443.9 | +0.6% |
| 7200 | 1527.5 | +2.1% |
| 7400 | 1576.9 | +3.4% |
| 7600 | 1663.9 | +8.6% |
| 7800 | 1688.6 | +8.8% |
| 8000 | 1719.0 | +12.4% |
| 8200 | 1795.9 | +16.4% |
| 8400 | 1792.1 | +16.3% |
| 8600 | 1813.9 | +17.0% |
| 8800 | 1861.9 | +16.7% |
| 9000 | 1852.3 | +14.3% |
| 9200 | 1843.2 | +11.2% |
| 9400 | 1834.0 | 14.6% |

DETAILED DESCRIPTION OF PREFERRED EMBODIMENTS (SECOND MOD)

FIGS. 11-15 generally depict the Second Mod configuration of the present invention. For components of the Second Mod configuration identical to those of the First Mod, reference may be made to FIGS. 1-10.

FIG. 11 depicts the gear compressor/supercharger 100 of the Second Mod configuration, having a housing 102 which defines first and second mutually adjacent parallel elongate overlapping cylindrical chambers 14*a*, 14*b* (see FIG. 3), and a front end 30 and a rear end 32, and a low pressure inlet port 34 (see FIG. 1) and a high-pressure discharge port 38.

FIG. 15 shows the gear compressor/supercharger 100 of the Second Mod having a pair of rotors 16*a*, 16*b* located in the respective cylindrical chambers 14*a*, 14*b* thereof. Rotors 16*a*, 16*b* function and are configured identically to those described above in respect of the First Mod, and will not be described further in detail.

High pressure discharge port 38 is situated on a bottom surface 104 of gear compressor/supercharger 100, proximate front end 30 thereof, to permit the exhausting of compressed fluid such as compressed air to, for example, the intake manifold on a supercharged internal combustion engine (not shown).

Low pressure inlet port 34, adapted to receive and direct inlet fluid, such as ambient air into the gear compressor/supercharger 100, is situated on a top side surface 36 (see FIG. 1) of gear compressor 100 proximate front end 30 thereof.

A divider wall 106 is provided on the bottom surface 104 of gear compressor 100, extending from front end 30 to rear end 32.

A forward portion 107 of such divider wall 106 contains an aperture, namely the high pressure discharge port 38. A rearward portion of divider wall 106 contains a substantially flat rear portion 108 (see FIGS. 12, 14) which partially covers an aperture 112 (see FIGS. 11-15) and is situated at the rear end 32 of gear compressor/supercharger 100.

As perhaps best seen in FIGS. 12 & 15, aperture 112 allows fluid communication between fluid within the gear compressor 100 which becomes compressed against the rear end 32 thereof, and high pressure fluid such as air discharged from high pressure discharge port 38. In a preferred embodiment shown in FIGS. 11-15, such fluid communication is accomplished by making the forward portion 107 of divider wall 106 arcuately curved upwardly from a horizontal plane (shown downwardly curved in FIGS. 11-15 due to looking at bottom of gear compressor 100), so as to provide a raised portion 114 substantially in the middle of divider wall 106 which may then serve as a linear channel 113 to permit fluid to flow between aperture 112 and aperture 38 (ie high pressure discharge port 38).

Due to rearward flat portion 108 of divider wall 106 covering a portion of aperture 112 as shown in FIGS. 12 and 14 when supercharger 100 is mounted on an inlet manifold of an engine, the remaining aperture 112 is situated in a plane perpendicularly disposed to the horizontal place and intermediate the rearward flat portion 108 of divider wall 106 and upwardly-curved rearward portion of the forward portion of divider wall 106, as best shown in FIGS. 12 and 14. As a result of such configuration aperture 112 is best suited to permit flow of fluid via channel 113 from aperture 112 to high pressure outlet 38 during a pressure surges at rear end 32 of supercharger 100, and to permit fluid flow into aperture 112 during pressure surges at high pressure discharge end 38 of supercharger 100.

In a preferred embodiment, a small cavity or plenum 120 is formed proximate aperture 112 and situated at the bottom and rear end 32 of supercharger 100, as best shown in FIGS. 14 and 15. Advantageously, plenum 120 is in fluid communication with aperture 112 and further serves to better allow fluid to be directed more smoothly from rear end 32 of supercharger 100 via aperture 112 along channel 113 to high pressure discharge port 38 during fluid pressure surges/pulses which occur at rear end 32 of supercharger 100, and to allow fluid to be more smoothly received at rear portions of rotors 16*a*, 16*b* when pressure surges/pulses are produced at forward end 30 proximate high pressure discharge port 38. As may be seen from FIG. 14, aperture 112 and plenum 120 are not relatively large in size compared to the area of high pressure discharge port 38. From experimentation conducted, it has been found that the ratio in areas between aperture 112 and that of high pressure discharge port 38 is as relatively depicted in FIG. 14 (aperture 112 partially closed and in operative configuration). The size of the plenum 120 is only, and need only, be the intermediate volume between the substantially flat rear divider wall 108 and the rotors 16*a*, 16*b* immediately above rear divider wall 108.

Practical tangible performance benefits of such configuration of the Second Mod described above, and in particular the benefits of providing aperture 112 and plenum 120 circumscribed by the open volume contained between flat rear divider wall 108 and rotors 16*a*, 16*b* are established by the test results comparing a conventional prior art supercharger as described in Example 5 below having performance test results shown in Table 5, with the Second Mod configuration further described in Example 6 having the performance test results shown in Table 6 below.

EXAMPLE 5

A publicly available model 6/71 standard helix supercharger manufactured by Kobelco Compressors (America) Inc. of Elkhart, Ind., exclusively distributed by DPME Inc. of Stevensville Mich., having a pair of helical 3-lobe rotors, each with a standard (but opposite) 60° helix angle per 16 inch rotor length, was used as a standard comparison, to evaluate the Second Mod.

To provide an accurate comparison for the Second Mod, such comparison required a slightly larger prior art supercharger be used over the model used for comparison purposes for the First Mod, and thus the model of supercharger in this Example 5 needed to be larger than the prior art model supercharger used in Example 1.

In this regard model 6/71 supercharger was mounted on a modified 521 cubic inch BAE Chrysler 8 cylinder methanol-fueled engine (not shown). A dynamometer test was run to determine horsepower produced at various RPM's for such engine, having mounted on the inlet manifold of such engine the above model 6/71 supercharger mounted thereon.

Set out below in Table 5 is a tabulation of horsepower generated by such supercharged Chrysler engine, running at 85 degrees F. ambient air conditions, with a relative humidity of 32%, and a barometric pressure of 26.4 inches.

TABLE 5

| RPM | Horsepower |
|---|---|
| 5600 | 1392.1 |
| 5800 | 1411.9 |
| 6000 | 1484.0 |
| 6200 | 1549.6 |
| 6400 | 1613.2 |
| 6600 | 1699.9 |
| 6800 | 1686.3 |
| 7000 | 1746.8 |
| 7200 | 1762.9 |
| 7400 | 1825.9 |
| 7600 | 1857.1 |
| 7800 | 1587.5 |
| 8000 | 1866.3 |
| 8200 | 1877.4 |

EXAMPLE 6

Above model 6/71 Kobelco supercharger was modified to conform such the "stock" prior art Kobelco supercharger to the supercharger 100 described as the Second Mod above.

The identical 521 BAE Chrysler engine, having the aforesaid Kobelco supercharger mounted on the engine block (inlet manifold) thereof, but modified as described above, was again run at various RPM. Operating conditions were substantially identical to those in Example 5, namely ambient temperature 84 degrees F., relative humidity 32%, and an ambient barometric pressure of 26.4 inches of mercury.

The generated horsepower was recorded at such various RPM, with the results tabulated in Table 6 below compared to the horsepower results from Table 5:

TABLE 6

| RPM | Example 6 | H.P. Change over Example 5 | % change |
|---|---|---|---|
| 5600 | 1522.4 | +130.3 | +9.4% |
| 5800 | 1595.4 | +183.5 | +13.0% |
| 6000 | 1673.3 | +189.6 | +12.8% |
| 6200 | 1731.5 | +181.9 | +11.7% |
| 6400 | 1764.9 | +151.7 | +9.4% |
| 6600 | 1804.8 | +104.9 | +6.2% |
| 6800 | 1882.0 | +195.7 | +11.6% |
| 7000 | 1939.1 | +192.3 | +11.0% |
| 7200 | 1978.3 | +215.4 | +12.2 |
| 7400 | 1977.2 | +151.3 | +8.3% |
| 7600 | 2001.8 | +144.7 | +7.8% |
| 7800 | 2011.8 | +154.3 | +8.3% |
| 8000 | 1981.5 | +115.2 | +6.2% |
| 8200 | 1935.7 | +58.3 | +3.1% |

Although the disclosure describes and illustrates preferred embodiments of the invention, it is to be understood that the invention is not limited to these particular embodiments. Many variations and modifications will now occur to those skilled in the art. For a complete definition of the invention and its intended scope, reference is to be made to the summary of the invention and the appended claims read together with and considered with the disclosure and drawings herein.

We claim:

1. A gear compressor for compressing compressible fluids such as air, comprising:

a housing defining first and second mutually adjacent, parallel, elongate overlapping cylindrical chambers, having a front end and a rear end and a low pressure inlet port and a high pressure discharge port thereon;

a pair of juxtaposed rotors, each disposed in a respective of said cylindrical chambers and each oppositely rotatable , each having a plurality of radially outwardly extending lobes thereon equidistantly circumferentially spaced about a periphery of each rotor and intermeshed along a side thereof with lobes of an opposite rotor of said pair of rotors, each of said lobes on said rotors twisted about a respective longitudinal axis of rotation of each rotor in a helix angle, each helix angle of each of said lobes on a first of said pair of rotors being equal and opposite to said helix angle of each of said lobes on said other of said pair of rotors, said rotors within said respective cylindrical chambers each adapted to transfer volumes of compressible low pressure fluid from said low pressure inlet port via spaces created between walls of said respective cylinder chambers and unmeshed lobes of each rotor axially along said respective cylindrical chambers from said front end to said rear end of said gear compressor and then axially back along said gear compressor to a location proximate said front end of said gear compressor and thereafter to said high pressure discharge port;

said high pressure discharge port situated on a bottom surface of said gear compressor proximate said front end thereof;

said low pressure inlet port situated on a top surface of said gear compressor proximate said front end thereof; and divider means situated on a bottom surface of said gear compressor extending from said front end to said rear end of said gear compressor, a first aperture in said divider means proximate said front end which comprises said high pressure discharge port; and a second aperture situated proximate said rear end of said compressor proximate said bottom surface;

said second aperture permitting fluid communication between an interior of said gear compressor at said rear end of said gear compressor and high pressure fluid discharged from said high pressure discharge port.

2. The gear compressor as claimed in claim 1, said divider means having a linear channel therein to permit fluid to flow between said first aperture and said second aperture.

3. The gear compressor as claimed in claim 2, said channel permitting fluid flow from said second aperture forwardly via said channel in said divider means to said first aperture or alternatively permitting fluid flow from said first aperture via said channel to said first aperture.

4. The gear compressor as claimed in claim 1, 2, or 3;

wherein a forward portion of said divider means is arcuately curved upwardly from a horizontal plane which defines said bottom surface, so as to provide a raised portion substantially in a middle of said divider means, and a rearward portion of said divider means is substantially flat and is situated within said horizontal plane; and said second aperture situated in a plane perpendicularly disposed to said horizontal plane, and intermediate the rearward flat portion and upwardly-curved portion of the divider means.

5. The gear compressor as claimed in claim 4, containing a plenum at said rear end of said gear compressor, said plenum situated immediately above said rearward substantially flat portion of said divider means, wherein said second aperture is in communication with said plenum.

6. The gear compressor of claim 5, wherein said second aperture permits fluid within said plenum to be in communication with said first aperture.

7. A supercharger for an internal combustion engine, comprising:

a housing defining first and second mutually adjacent, parallel, elongate overlapping cylindrical chambers, having a front end and a rear end and a low pressure inlet port and a high pressure discharge port thereon;

a pair of juxtaposed rotors, each disposed in a respective cylindrical chamber and oppositely rotatable, each having a plurality of radially outwardly extending lobes thereon equidistantly circumferentially spaced about a periphery of each rotor and intermeshed along a side thereof with lobes of an opposite rotor of said pair of rotors, each of said lobes on said rotors twisted about a respective longitudinal axis of rotation of each rotor in a helix angle, each helix angle of each of said lobes on a first of said pair of rotors being equal and opposite to said helix angle of each of said lobes on said other of said pair of rotors, said rotors within said respective cylindrical chambers each adapted to transfer volumes of compressible low pressure fluid from said low pressure inlet port via spaces created between walls of said respective cylinder chambers and unmeshed lobes of each rotor axially along said respective cylindrical chambers from said front end to said rear end of said supercharger and then axially back along said supercharger to a location proximate said front end of said supercharger and thereafter to said high pressure discharge port;

said high pressure discharge port situated forwardly of said supercharger proximate said front end thereof;

said low pressure inlet port situated on a side of said supercharger opposite said high pressure discharge port, and likewise situated forwardly of said supercharger proximate said front end thereof; and divider means situated on a bottom surface of said supercharger extending from said front end to said rear end of said supercharger, a first aperture in said divider means proximate said front end of said supercharger which comprises said high pressure discharge port; and a second aperture situated proximate said rear end of said supercharger proximate said bottom surface;

said second aperture permitting fluid communication between an interior of said supercharger at said rear end of said supercharger and high pressure fluid discharged from said high pressure discharge port proximate a forward end of said supercharger.

8. The supercharger as claimed in claim 7, said divider means having a substantially linear horizontally-extending channel therein to permit fluid to flow between said first aperture and said second aperture.

9. The supercharger as claimed in claim 8, said channel permitting fluid flow from said second aperture forwardly via said channel in said divider means to said first aperture or alternatively permitting fluid flow from said first aperture via said channel to said first aperture.

10. The supercharger as claimed in claim 8 or 9 containing a plenum at said rear end of said supercharger, said plenum situated immediately above said rearward flat portion of said divider means, wherein said second aperture is in communication with said plenum.

11. The supercharger as claimed in claim 8 or 9 containing a plenum at said rear end of said supercharger, said plenum situated immediately above said rearward flat portion of said divider means, wherein said second aperture is in communication with said plenum, and wherein said second aperture permits fluid within said plenum to be in communication with said first aperture.

12. The supercharger as claimed in claim 8 or 9, wherein a forward portion of said divider means is arcuately curved upwardly from a horizontal plane which defines said bottom surface, so as to provide a raised portion in a middle of said divider means, and a rearward portion of said divider portion is flat and is situated within said horizontal plane;

said second aperture situated in a plane perpendicularly disposed to said horizontal plane, and intermediate said rearward flat portion and said upwardly-curved portion of said divider means; and containing a plenum at said rear end of said supercharger, said plenum situated immediately above said rearward flat portion of said divider means, wherein said second aperture is in communication with said plenum.

13. The supercharger as claimed in claim 8 or 9, wherein a forward portion of said divider means is arcuately curved upwardly from a horizontal plane which defines said bottom surface, so as to provide a raised portion in a middle of said divider means, and a rearward portion of said divider portion is flat and is situated within said horizontal plane;

said second aperture situated in a plane perpendicularly disposed to said horizontal plane, and intermediate said rearward flat portion and said upwardly-curved portion of said divider means; and containing a plenum at said rear end of said supercharger, said plenum situated immediately above said rearward flat portion of said divider means, wherein said second aperture is in communication with said plenum, and wherein said second aperture permits fluid within said plenum to be in communication with said first aperture.

14. The supercharger as claimed in claim 7, 8, or 9;

wherein a forward portion of said divider means is arcuately curved upwardly from a horizontal plane which defines said bottom surface, so as to provide a raised portion substantially in a middle of said divider means, and a rearward portion of said divider portion is substantially flat and is situated within said horizontal plane; and said second aperture situated in a plane perpendicularly disposed to said horizontal plane, and intermediate said rearward flat portion and said upwardly-curved portion of said divider means.

* * * * *